US008974031B2

(12) United States Patent
Numata

(10) Patent No.: US 8,974,031 B2
(45) Date of Patent: Mar. 10, 2015

(54) INKJET PRINTER

(71) Applicant: Taketo Numata, Aichi (JP)

(72) Inventor: Taketo Numata, Aichi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/224,701

(22) Filed: Mar. 25, 2014

(65) Prior Publication Data

US 2014/0292872 A1 Oct. 2, 2014

(30) Foreign Application Priority Data

Mar. 27, 2013 (JP) ..... 2013-067335

(51) Int. Cl.
*B41J 2/045* (2006.01)

(52) U.S. Cl.
CPC ..... *B41J 2/04508* (2013.01)
USPC ..... 347/14; 347/19

(58) Field of Classification Search
CPC ..... B41J 19/142; B41J 19/145; B41J 19/147; B41J 19/02; B41J 2/04573; B41J 2/04591; B41J 2/04586; B41J 2/0459; B41J 2/04503; H04N 2201/04786
USPC ..... 347/14, 19, 20, 37, 57
See application file for complete search history.

(56) References Cited

U.S. PATENT DOCUMENTS 6,631,976 B2 * 10/2003 Hamamoto et al. ..... 347/35
2014/0292852 A1 10/2014 Numata

FOREIGN PATENT DOCUMENTS

JP 2000-218868 A 8/2000
JP 2005-199584 A 7/2005

OTHER PUBLICATIONS

U.S. Appl. No. 14/224,733, "Injet Printer" filed Mar. 25, 2014.

* cited by examiner

*Primary Examiner* — Thinh Nguyen
(74) *Attorney, Agent, or Firm* — Merchant & Gould PC

(57) ABSTRACT

An inkjet printer including a body, a carriage, a recording head, a bendable connecting member, and a controller is provided. The controller executes a moving step to move the carriage in an orientation after the carriage is halted for a length, a measuring step to measure the period, and a discharging step to manipulate the recording head to discharge ink at a sheet. In the discharging step, if the measured period is within a first length, the recording head is manipulated to discharge the ink at a first discharging timing, and if the measured period is within a second length which is longer than the first length, the recording head is manipulated to discharge the ink at a second discharging timing, which is advanced to be earlier than the first discharging timing.

13 Claims, 11 Drawing Sheets

FIG. 8

| | DEVIATED AMOUNT | | | | |
|---|---|---|---|---|---|
| PAUSING PERIOD \ TARGETED POSITION | $L_1$ | ... | $L_3$ | ... | $L_4$ |
| 10 msec | 0 | ... | 0 | ... | 0 |
| 50 msec | $\alpha_1$ | ... | $\beta_1$ | ... | 0 |
| 100 msec | $\alpha_2$ | ... | $\beta_2$ | ... | 0 |
| ... | ... | | ... | | ... |
| 1000 msec | $\alpha_3$ | ... | $\beta_3$ | ... | 0 |

INKJET PRINTER

CROSS-REFERENCE TO RELATED APPLICATION

This application claims priority under 35 U.S.C. §119 from Japanese Patent Application No. 2013-067335 filed on Mar. 27, 2013. The entire subject matter of the application is incorporated herein by reference.

BACKGROUND

1. Technical Field

The following description relates to an inkjet printer capable of correcting deviated ink-landing positions for ink to land with respect to targeted positions on a sheet.

2. Related Art

An inkjet printer configured to record an image by discharging ink from a recording head, which is mounted on a carriage, at a recording sheet while the carriage moves along a main scanning direction, is known. The recording head in the inkjet printer may be configured to discharge the ink supplied through an ink tube at the sheet in accordance with discharging timings, which are obtained from a controller through a controller cable. Thus, the recording head being movable may be connected with other components by connecting members such as the ink tube and the controller cable.

The connecting members may be connected to the recording head at one ends thereof and may be movable along with the carriage. Therefore, in order for the connecting members to be elastically deformable to follow the moving carriage smoothly, the connecting members may be flexible and resilient.

SUMMARY

In such an inkjet printer, therefore, the resiliency of the deformed connecting member may influence the carriage, and an amount of a gap between the resiliency-influenced recording head and the recording sheet may fluctuate. Due to the fluctuation of the gap amount between the recording head and the recording sheet, landing positions for the ink to land on the recording sheet may deviate from targeted positions. As a result of the deviation of the landing positions with respect to the targeted positions, quality of recorded images may be deteriorated undesirably. In this regard, the carriage may be more likely to be influenced by the resiliency of the connecting members when the carriage is maintained motionless than when the carriage is in motion.

Aspects of the present invention are advantageous in that an inkjet printer, by which deterioration of image recording quality can be prevented, is provided. More specifically, the deterioration of the image recording quality can be prevented by correcting the landing positions, which may be deviated by the resiliency of the elastically deformable connecting members.

According to an aspect of the present invention, an inkjet printer is provided. The inkjet printer includes a body; a carriage configured to move in an orientation from one end part toward the other end part; a recording head mounted on the carriage and configured to discharge ink toward a targeted position on a sheet; a connecting member connected to the body and the carriage, the connecting member being configured to be bendable in variable curvature along with the carriage being moved, the curvature being greater when the carriage is at the one end part than when the carriage is at the other end part; and a controller configured to execute a plurality of steps. The plurality of steps include a moving step, in which the carriage is moved in the orientation after a period where the carriage is halted at the one end part for a length; a measuring step, in which the period prior to the moving step is measured; and a discharging step, in which the recording head is manipulated to discharge the ink at the targeted position in the moving step. If the measured period is within a first length, in the discharging step, the recording head is manipulated to discharge the ink toward the targeted position at a first discharging timing. If the measured period is within a second length which is longer than the first length, in the discharging step, the recording head is manipulated to discharge the ink toward the targeted position at a second discharging timing, the second discharging timing being advanced to be earlier than the first discharging timing.

According to another aspect of the present invention, a method to be executed by an inkjet printer is provided. The method includes a moving step, in which a carriage is moved from one end part toward the other end part after a period where the carriage is halted at the one end part for a length; a measuring step, in which the period prior to the moving step is measured; and a discharging step, in which a recording head mounted on the carriage is manipulated to discharge the ink at a targeted position on the sheet in the moving step. If the measured period is within a first length, in the discharging step, the recording head is manipulated to discharge the ink toward the targeted position at a first discharging timing. If the measured period is within a second length which is longer than the first length, in the discharging step, the recording head is manipulated to discharge the ink toward the targeted position at a second discharging timing, the second discharging timing being advanced to be earlier than the first discharging timing.

BRIEF DESCRIPTION OF THE ACCOMPANYING DRAWINGS

Figure 7:
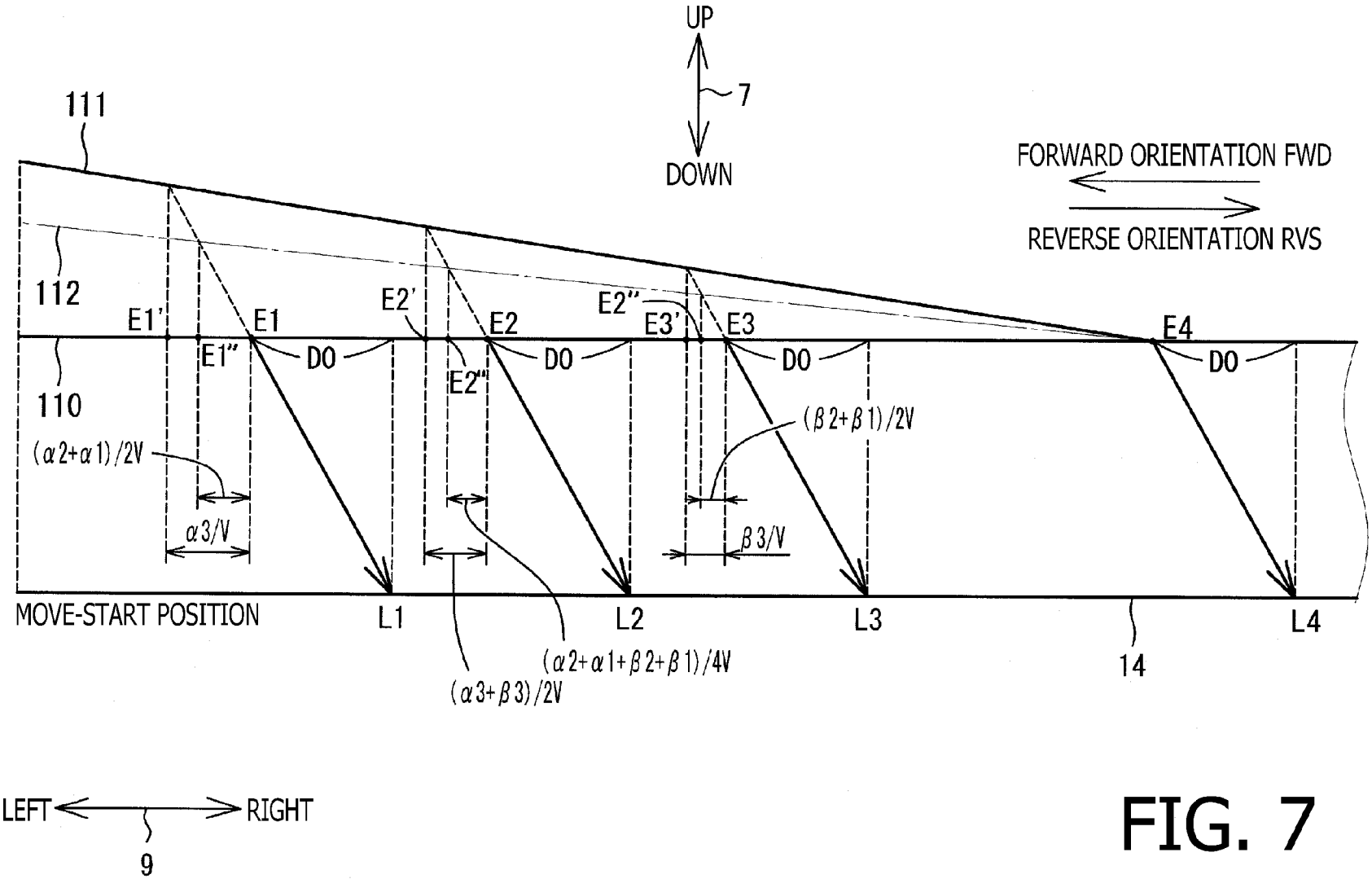

FIG. 7 is a diagram to illustrate relative positions among trajectories 110, 111, 112 of the carriage 23 and a sheet 14 in the MFD 10 according to the embodiment of the present invention.

FIG. 8 illustrates a data structure in an EEPROM 134 in the MFD 10 according to the embodiment of the present invention.

Figure 9:
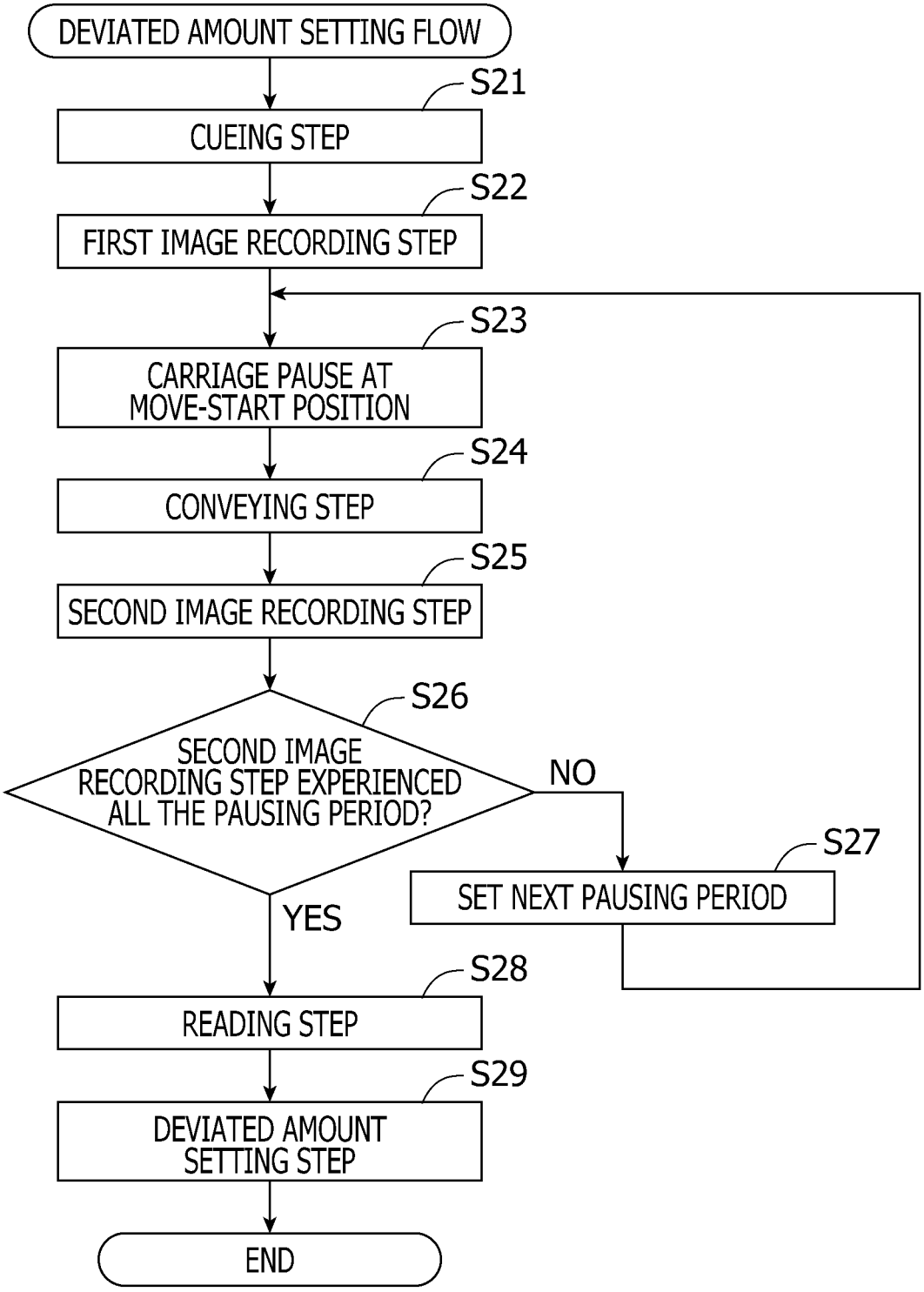
Figure 10:
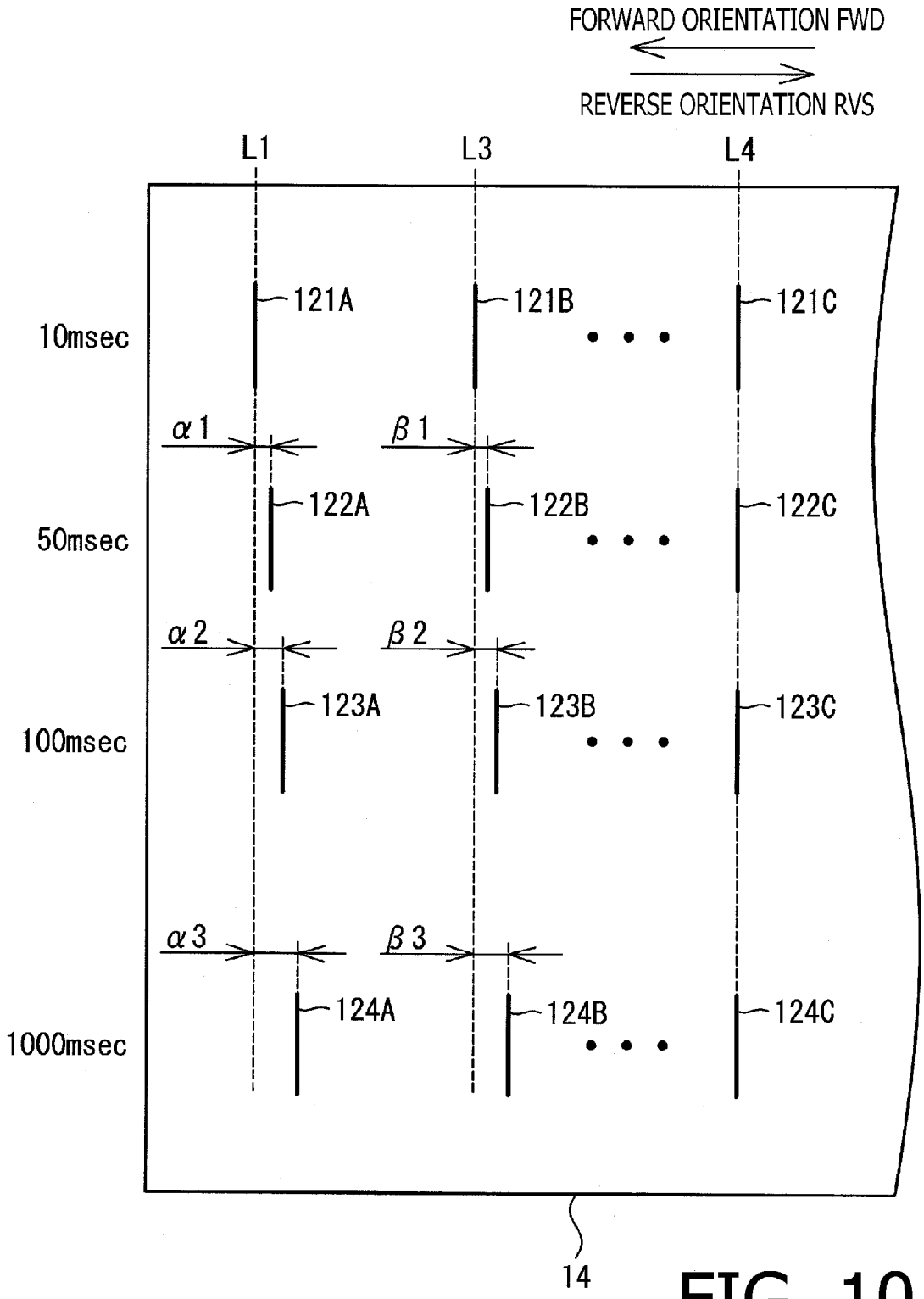

FIG. 9 is a flowchart to illustrate a flow of a deviated amount setting operation to be performed by the controller 130 in the MFD 10 according to the embodiment of the present invention, FIG. 10 is an example of an image pattern recorded according to the deviation values set in the deviated amount setting operation performed by the controller 130 in the MFD 10 according to the embodiment of the present invention.

Figure 11:
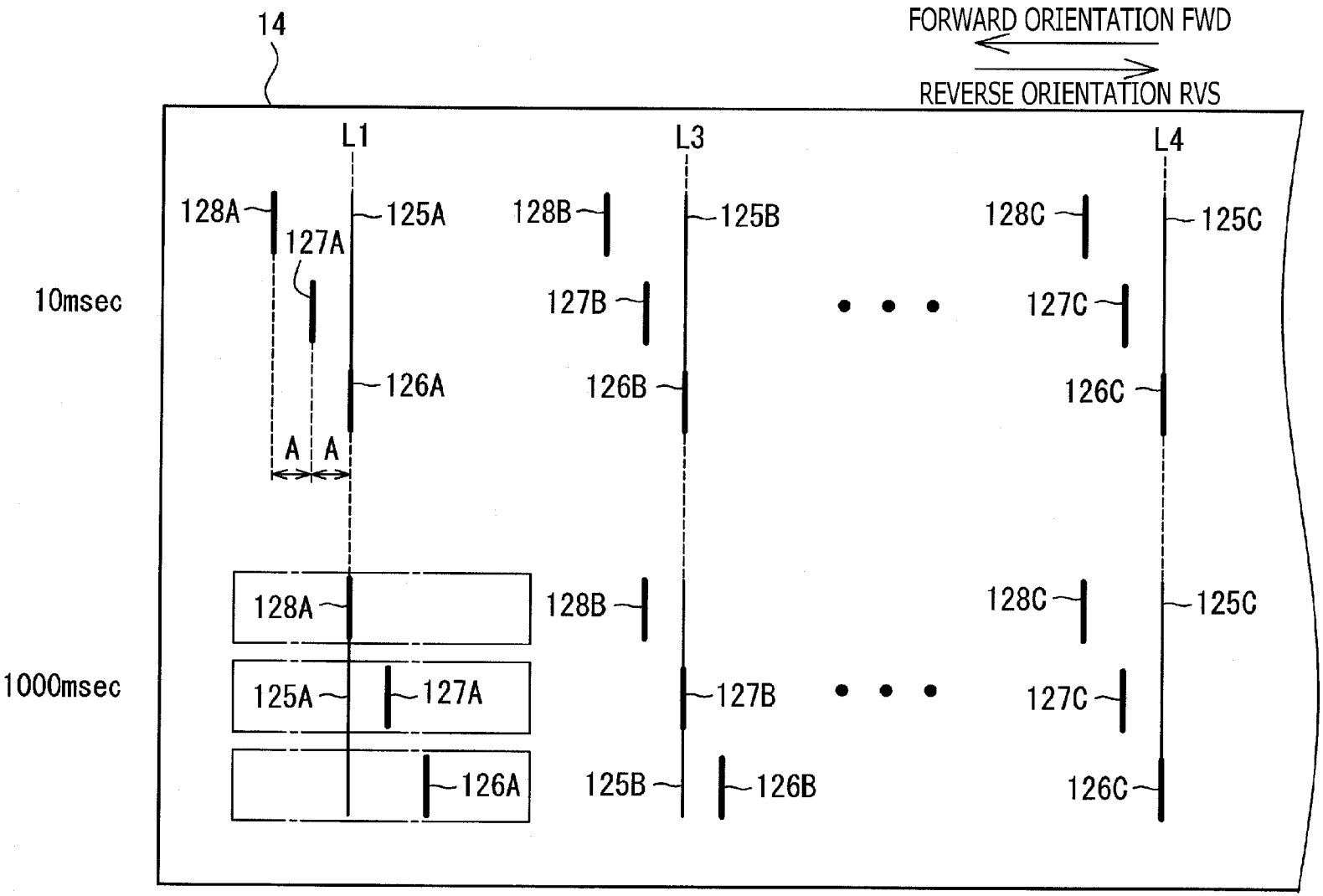

FIG. 11 is another example of the image pattern recorded according to the deviation values set in the deviated amount setting operation performed by the controller 130 in the MFD 10 according to the embodiment of the present invention.

DETAILED DESCRIPTION

Hereinafter, an embodiment according to aspects of the present invention will be described in detail with reference to the accompanying drawings. It is noted that various connections are set forth between elements in the following description. These connections in general and, unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

Figure 1:
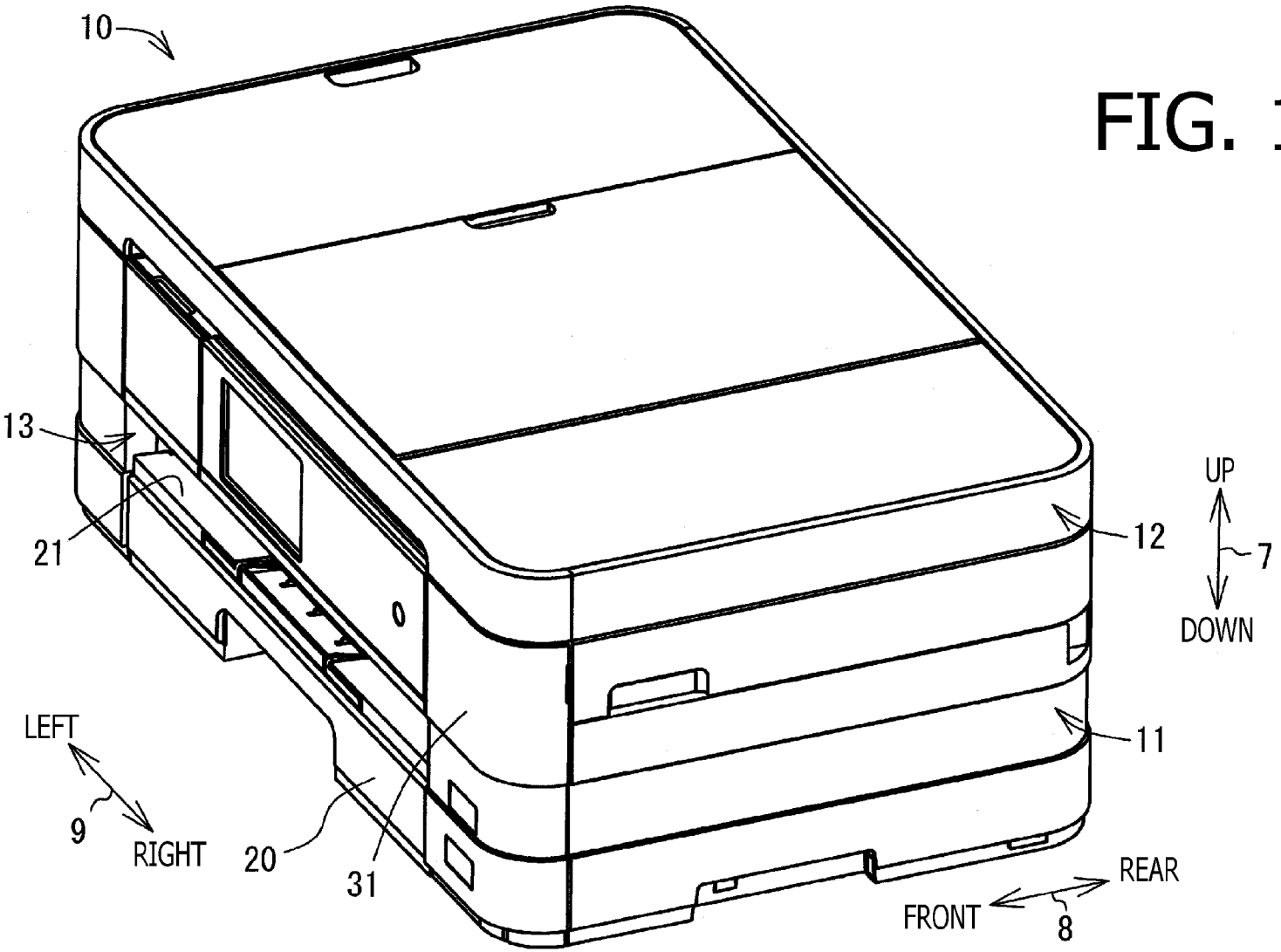
FIG. 1 is an external perspective view of a multifunction device (MFD) 10 according to an embodiment of the present invention.

In the following description, a vertical direction 7 is defined with reference to an up-to-down or down-to-up direction for the MFD 10 in an ordinarily usable posture (see. FIG. 1). In other words, the up-to-down or down-to-up direction in FIG. 1 coincides with the vertical direction 7. Further, other directions concerning MFD 10 be referred to based on the ordinarily usable posture of the MFD 10: a viewer's lower-left side in FIG. 1, on which an opening 13 is formed, is defined to be a front side of the MFD 10, and a side opposite from the front side, i.e., a viewer's upper-right side, is defined as a rear side of the MFD 10. A front-to-rear or rear-to-front direction is defined as a direction of depth and may be referred to as a front-rear direction 8. An upper-left side in FIG. 1, which comes on the user's left-hand side with respect to the MFD 10 when the user faces the front side, is referred to as a left side or a left-hand side. A side opposite from the left, which is on the viewer's lower-right side, is referred to as a right side or a right-hand side. A right-to-left or left-to-right direction of the MFD 10 may also be referred to as a right-left direction 9 or a widthwise direction 9. The directions shown in FIGS. 2-5 and 8-9 correspond to those indicated by the arrows appearing in FIG. 1.

First Embodiment

Overall Configuration of the MFD 10

As depicted in FIG. 1, the MFD 10 has an overall shape of a six-sided rectangular box and contains a scanner part 12 and a printer part 11. In the scanner part 12, an original image appearing on an original sheet can be read, and image data representing the read image can be created. In the printer part 11, an image can be recorded on a sheet 14 (see FIG. 2) in an inkjet recording method. In the MFD 10 according to the present embodiment, the scanner part 12 is disposed in an upper position while the printer part 11 is disposed in a lower position.

[Scanner Part 12]

The scanner part 12 includes an image reader unit being a flatbed scanner (FBS) and an auto document feeder (ADF) arranged on top of the image reader unit, which are not shown. The image reader unit includes a piece of contact glass, on which the original sheet to be read is placed, and a contact image sensor (CIS) unit, which is movable to reciprocate underneath the contact glass. The CIS unit can read an image recorded on the original sheet placed on the contact glass and an image recorded on the original sheet being conveyed by the ADF. The ADF conveys the original sheet placed on an original tray to a readable position in the CIS unit and ejects the original sheet, of which recorded image has been read by the CIS unit, to an ejection tray.

[Printer Part 11]

Figure 2:
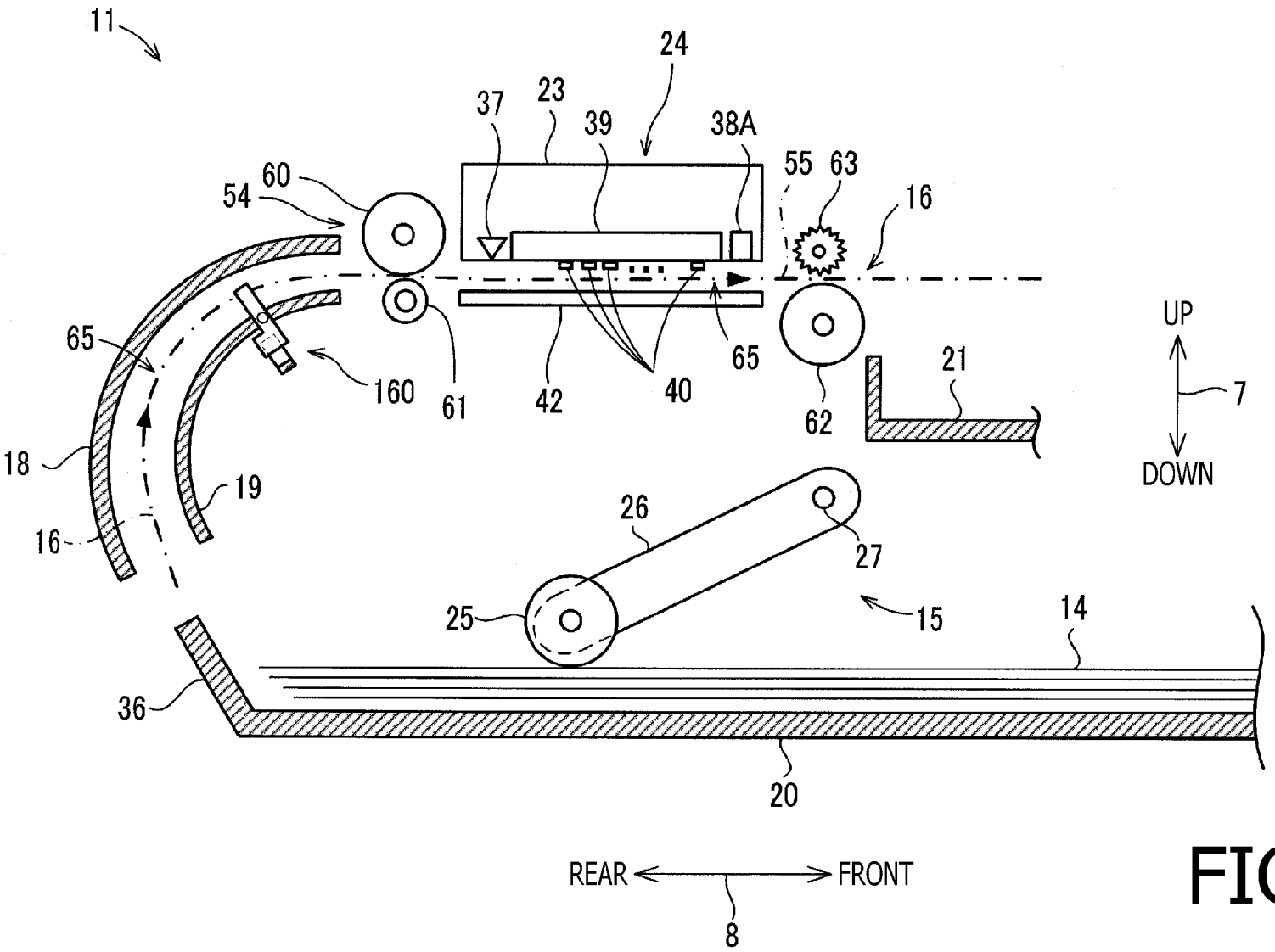
FIG. 2 is a cross-sectional view of an internal structure of a printer part 11 in the MFD 10 according to the embodiment of the present invention.

As depicted in FIG. 2, the printer part 11 includes a feeder unit 15, a feeder tray 20, an ejection tray 21, to conveyer roller unit 54, a recording unit 24, an ejection roller unit 55, and a platen 42.

The printer part 11 is formed to have an opening 13 on a front side thereof. Through the opening 13, the feeder tray 20 to accommodate the recording sheets 14 may be detachably attached to the printer part 11. The feeder tray 20 may accommodate a plurality of sizes of recording sheets 14 therein. The feeder unit 15 is configured to pick up the sheet 14 from the feeder tray 20 and feed the picked-up sheet 14 in a conveyer path 65. The conveyer roller unit 54 conveys the sheet 14 fed by the feeder unit 15 in the conveyer path 65 further toward a downstream along a direction of conveying flow 16. The recording unit 24 records an image on the sheet 14 conveyed by the conveyer roller unit 54. The ejection roller unit 55 ejects the sheet 14 with the image recorded thereon by the recording unit 24 in the ejection tray 21. An ejection tray 21 to catch ejected recording sheets 14 is arranged in an upper position with respect to the feeder tray 21. The platen 42 supports the sheet 14 having been conveyed by the conveyer roller unit 54 from below at a position where the sheet 14 faces the recording unit 24.

[Feeder Unit 15]

As depicted in FIG. 2, in an upper position with respect to the feeder tray 20 which is attached through the opening 13 in the printer part 11, the feeder unit 15 is arranged. The feeder unit 15 includes a feed roller 25, a feeder arm 26, and a shaft 27. The feed roller 25 is rotatably attached to one end of the feeder arm 26, which is movable upward and downward to be closer to and farther from the feeder tray 20. The feed roller 25 is rotatable by a driving force, which is generated by a conveyer motor 102 (see FIG. 5). The feeder arm 26 is pivotably supported by the shaft 27, which is supported by a frame (not shown) of the printer part 11. The feeder arm 26 is urged downward by weight thereof and/or resilient force provided by, for example, a spring. When one or more recording sheets 14 are placed in the feeder tray 20, and when the feed roller 25 relates, a topmost one of the recording sheets 14 placed in the feeder tray 20 is picked up and fed in the conveyer path 65. Below is description of the conveyer path 65.

[Conveyer Path 65]

As depicted in FIG. 2, the conveyer path 65 refers to an area partitioned by an outer guide member 18 and an inner guide member 19, which are arranged in the printer part 11 to face each other with a predetermined clearance maintained in there-between. The conveyer path 65 rises from a rear end of the feeder tray 20 and curves upper-frontward in the printer part 11 to extend from the rear side along the recording unit 24 to the ejection tray 21. More specifically, the conveyer path 65 extends through a nipped position in the conveyer roller unit 54, an upper position with respect to the platen 42, and a nipped position in the ejection roller unit 55 to the ejection tray 21. The conveying flow 16 of the sheet 14 to be conveyed in the conveyer path 65 is indicated by a dash-and-dot line shown in FIG. 2.

[Conveyer Roller Unit 54]

As depicted in FIG. 2, the conveyer roller unit 54 is disposed in an upstream position in the conveyer path 65 with respect to the recording unit 24 along the direction of the conveying flow 16. The conveyer roller unit 54 includes a conveyer roller 60 and a pinch roller 61. The conveyer roller 60 is driven by a conveyer motor 102. The pinch roller 61 is arranged in a position to face the conveyer roller 60 across the conveyer path 65 and is rotated along with rotation of the conveyer roller 60. The conveyer roller 60 and the pinch roller 61 nip the sheet 14 in the en and convey the nipped sheet 14 along the conveying flow 16.

[Ejection Roller Unit 55]

As depicted in FIG. 2, in the conveyer path 65, the ejection roller unit 55 is disposed in a downstream position with respect to the recording unit 24. The ejection roller unit 55 includes an ejection roller 62 and a spur 63. The ejection roller 62 is driven by the conveyer motor 102. The spur 63 is arranged in a position to face the ejection roller 62 across the conveyer path 65 and is rotated along with rotation of the ejection roller 62. The ejection roller 62 and the spur 63 nip the sheet 14 in there-between and convey the nipped sheet 14 along the conveying flow 16. Thus, the sheet 14 can be conveyed by the conveyer roller unit 54 and the ejection roller unit 55 along the direction of the conveying flow 16 in the conveyer path 65.

[Platen 42]

As depicted in FIG. 2, the platen 42 is arranged in a position between the conveyer roller unit 54 and the ejection roller unit 55, that is, in a downstream position with respect to the conveyer roller unit 54 and an upstream position with respect to the ejection roller unit 55 along the direction of the conveying flow 16, and in a lower position with respect to the conveyer path 65. The platen 42 is arranged to vertically face the recording unit 24 to support the sheet 14 being conveyed in the conveyer path 65 from below.

[Registration Sensor 160]

As depicted in FIG. 2, in an upstream position with respect to the conveyer roller 54 along the direction of the conveying flow 16 in the conveyer path 65, a known registration sensor 160 is disposed. The registration sensor 160 is a sensor configured to detect presence (or absence) of the sheet 14 in a detectable position of the registration sensor 160. When presence of the sheet 14 in the detectable position is detected, the registration sensor 160 outputs low-leveled signals, of which level is under a predetermined threshold, to a controller 130. The controller 130 will be described later in detail. Meanwhile, when absence of the sheet 14 in the detectable position is detected, the registration sensor 160 outputs high-leveled signals, of which level is higher than or equal to the predetermined threshold, to the controller 130.

[Rotary Encoder 170]

The printer part 11 includes a known rotary encoder 170 (see FIG. 5), which generates pulse signals in accordance with rotation of the conveyer roller 60. The rotary encoder 170 includes an encoder disk (unsigned) and an optical sensor (not shown). As the encoder disk rotates along with the rotation of the conveyer roller 60, the optical sensor detects the rotation of the encoder disk. Thus, the optical sensor generates pulse signals according to the rotation and outputs the generated pulse signals to the controller 130.

[Recording Unit 24]

Figure 3:
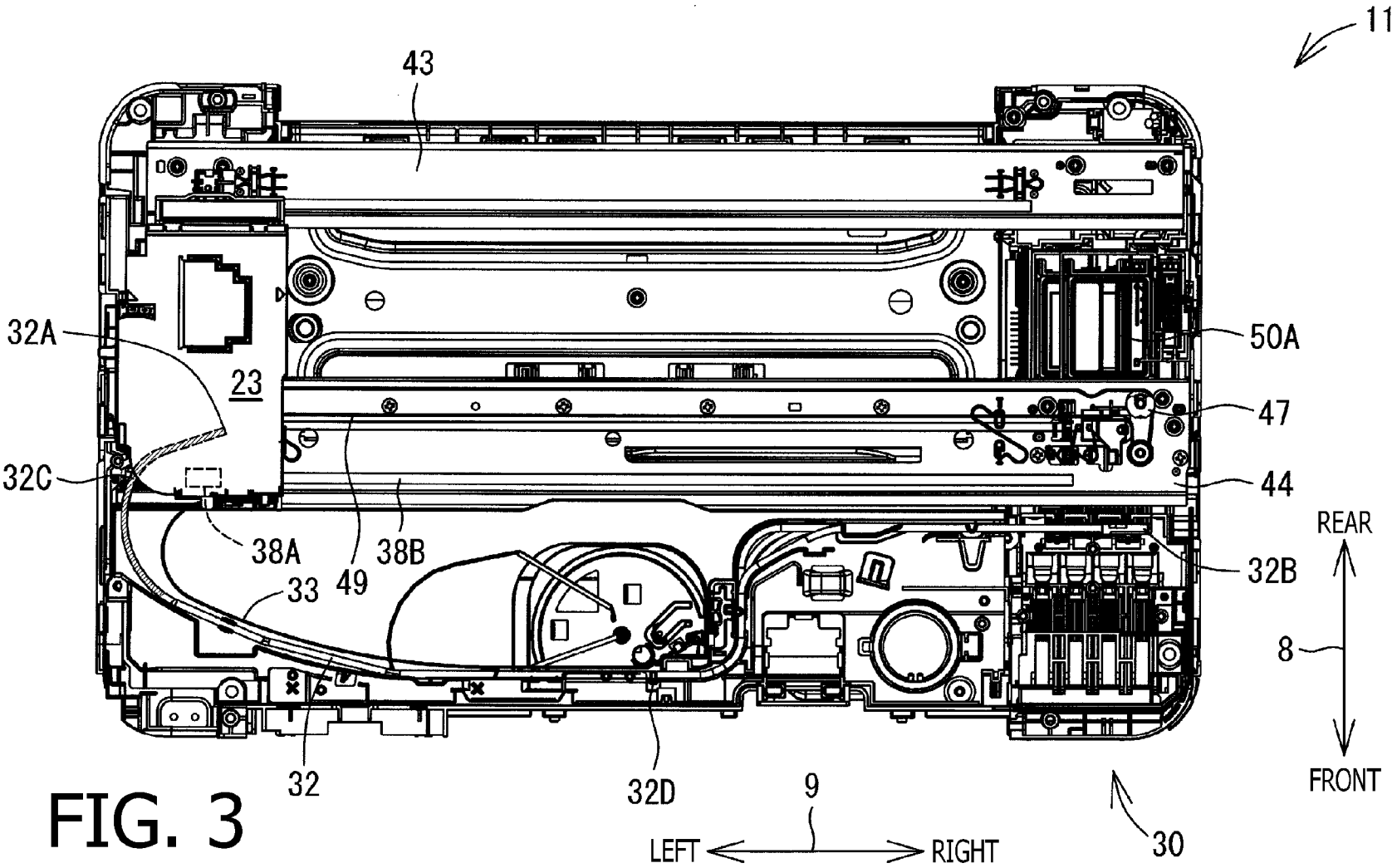
FIG. 3 is a plane view of a printer part 11 with a carriage 23 located at a left-side end in the MFD 10 according to the embodiment of the present invention.
Figure 4:
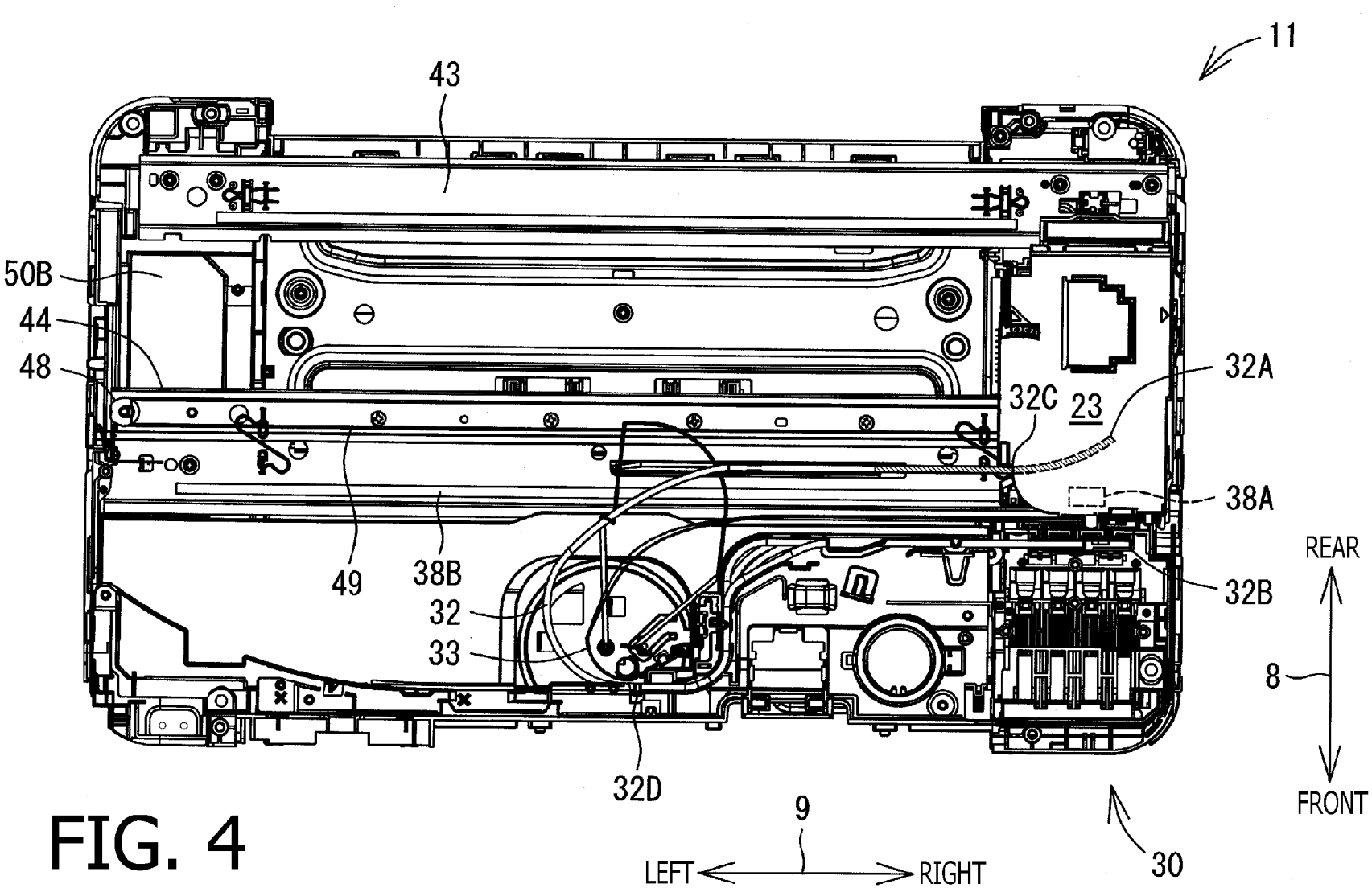
FIG. 4 is a plane view of the printer part 11 with the carriage 23 located at a right-side end in the MFD 10 according to the embodiment of the present invention.

As depicted in FIG. 2, the recording unit 24 is arranged in an upper position with respect to the conveyer path 65 in as position where the recording unit 24 faces the platen 42 vertically. The recording unit 24 includes a carriage 23, a recording head 39, a medium sensor 37, and an encoder sensor 38A. The carriage 23 is movable along the widthwise direction 9, which is orthogonal to the direction of the conveying flow 16. As depicted in FIGS. 3 and 4, ink tubes 32 and a flexible flat cable extend from the carriage 23.

As depicted in FIG. 2, the recording head 39 is mounted on the carriage 23. On a bottom plane of the recording head 39, a plurality of nozzles 40 are formed. Ink to be discharged from the nozzles 40 of the recording head 39 is supplied from an ink cartridge (not shown) to the recording head 39. Thus, while the ink is supplied to the recording head 39, the recording head 39 discharges minute droplets of the ink through the nozzles 40. As the carriage 23 with the recording head 39 mounted thereon is moved, the recording head 39 selectively discharges the ink droplets at the sheet 14, which is supported by the platen 42. Thus, an image is formed in the ink on the sheet 14.

As depicted in FIGS. 3 and 4, the carriage 23 is supported by guide rails 43, 44, which are arranged on a rear side and a front side of the platen 42 respectively. Meanwhile, the guide rails 43, 44 are supported by the printer part 11. The carriage 23 is attached to a known belt-driving mechanism, which is arranged on the guide rail 44. The belt-driving mechanism includes a driving pulley 47, which is arranged on one widthwise end of the guide rail 44 along the widthwise direction 9, a driven pulley 48, which is arranged on the other widthwise end of the guide rail 44 along the widthwise direction 9, and an endless loop belt 49, which is rolled around the driving pulley 47 and the driven pulley 48. The driving pulley 48 is driven by a carriage motor 103 (see FIG. 5). Meanwhile, the carriage 23 is attached to the belt 49 at a bottom part thereof. When the driving pulley 47 is rotated by the carriage motor 103, and the belt 49 is rolled along with the rotation of the driving pulley 47, the carriage 23 attached to the belt 49 reciprocates along the widthwise direction 9.

In the first embodiment, a leftward movement of the carriage 23 from a right-side end toward a left-side end along the widthwise direction 9 will be referred to as a forward travel or a travel in a forward orientation FWD (see FIG. 7). On the other hand, a rightward movement of the carriage 23 from the left-side end toward the right-side end along the widthwise direction 9 will be referred to as a reverse travel or a travel in a reverse orientation RVS (see FIG. 7). In the NTH) 10 according to the first embodiment, the image is recorded on the sheet 14 when the recording head 39 discharges the ink through the nozzles 40 while the carriage 23 travels in the reverse orientation RVS. However, the image may be recorded on the sheet 14 when the recording head 39 discharges the ink through the nozzles 40 while, for example, but not limited to, the carriage 23 travels in the forward orientation FWD.

On the guide rail 44, an encoder strip 38B extending along the widthwise direction 9 is arranged. The encoder strip 38B includes transparent portions and opaque portions, which are arranged alternately along a longitudinal direction thereof. Meanwhile, the encoder sensor 38A is mounted on the bottom surface of the carriage 23 and in a downstream position with respect to the nozzles 40 along the direction of the conveying flow 16. In this regard, the encoder sensor 38A and the encoder strip 38B are arranged in positions to face each other vertically along the vertical direction 7. Therefore, while the carriage 23 is moved along the widthwise direction 9, the encoder sensor 38A detects the transparent portions and the opaque portions when passing them by and generates pulse signals according to the transparency of the encoder strip 38B and outputs the generated pulse signals to the controller 130.

[Medium Sensor 37]

The medium sensor 37 is, as depicted in FIG. 2, mounted on the bottom surface of the carriage 23 and in an upstream position with respect to the nozzles 40 along the direction of the conveying flow 16. The medium sensor 37 is used to detect the sheet 14 being conveyed in the conveyer path 65. The medium sensor 37 may also be used in a reading step (see FIG. 9), which will be described later in detail.

The medium sensor 37 includes a light emitter (not shown), such as a light-emitting diode, and a light receiver (not shown), such as an optical sensor. The light emitter emits light toward the platen 42 (see FIG. 2) as instructed by the controller 130. The light emitted toward the platen 42 is reflected on the platen 42, when no sheet 14 is on the platen 42, or on the sheet 14 when the sheet 14 is on the platen 42. The light reflected on either the platen 42 or the sheet 14 is received by the light emitter. The medium sensor 37 then outputs signals of specific intensity according to the amount of the reflected light received by the light receiver to the controller 130. For example, but not limited to, the greater the amount of the received reflection is, the higher the level of the signals output by the medium sensor 37 may be.

[Cartridge Mount 30]

As depicted in FIGS. 3 and 4, on a rightward front side of the printer part 11, a cartridge mount 30 is provided. Meanwhile, as depicted in FIG. 1, on the rightward front side of the printer part 11, a cover 31 to cover an opening formed in the cartridge mount 30 is arranged. When the cover 31 is removed, the cartridge mount 30 is exposed. On the cartridge mount 30, ink cartridges (not shown) can be mounted. In the present embodiment, four (4) ink cartridges for four (4) colored inks, which are cyan, magenta, yellow, and black, can be detachably attached to the MFD 10 through the cartridge mount 30.

[Ink Tube 32]

The ink tube 32 connects the ink cartridges mounted on the cartridge mount 30 with the recording head 39 in the recording unit 24. The ink tube 32 includes four (4) resin-made elongated tubes, each of which is connected to one of the four colored ink cartridges. In particular, the four ink tubes 32 are aligned side by side along a direction orthogonal to the longitudinal direction thereof and tied with one another at an intermediate position thereof.

As depicted in FIGS. 3 and 4, at one end of the ink tube 32 along the longitudinal direction, a terminal part 32A of the ink tube 32 is fixed inside the carriage 23 and connected to the recording head 39. On the other hand, an origin part 32B on the other end of the ink tube 32 along the longitudinal direction is fixed to the cartridge mount 30 and connected to the ink cartridges through the cartridge mount 30. Thereby, the ink in the ink cartridges mounted on the cartridge mount 30 can be supplied to the recording head 39 through the ink tube 32.

The ink tube 32 includes an extending part 32C in between the terminal part 32A and the origin part 32B, and the ink tube 32 extends outward from the carriage 23 at a part closer to the origin part 32B with respect to the extending part 32C. Thus, a part of the ink tube 32 closer to the terminal part 32A with respect to the extending part 32C is arranged inside the carriage 23 while a reminder of the ink tube 32 closer to the origin part 3213 with respect to the extending part 32C is arranged outside the carriage 23. The ink tube 32 is fixed to a widthwise center position along the widthwise direction 9 in the printer part 11 at a fixed part 32D, which is in a position between the extending part 32C and the origin part 32B. In this regard, a length of the ink tube 32 between the terminal part 32A and the extending part 320 is shorter than a length of the ink tube 32 between the extending part 32C and the fixed part 32D. In other words, the extending part 32C is in a position closer to the terminal part 32A with respect to the fixed part 32L).

The ink tube 32 has a feature of flexural rigidity to some extent and is substantially flexible and rigid to maintain a posture thereof in a straight shape. Therefore, when an external force is applied to the ink tube 32, the ink tube 32 can be bended due to the flexibility. When the ink tube 32 is released from the external force, the ink tube 32 tends to restore to the straight shape due to the resiliency. The ink tube 32 is thus resiliently deformable to follow the reciprocating carriage 23 smoothly. In particular, the ink tube 32 is resiliently deformable at least at the part between the terminal part 32A and the fixed part 32D.

More specifically, when the carriage 23 is at the left-side end along the widthwise direction 9. As depicted in FIG. 3, the ink tube 32 is bended to place the extending part 32C, the terminal part 32A, the fixed part 32D, and the origin part 3213 to be arranged, from left to right, in the order of being mentioned. In other words, the extending part 32C is placed in the leftmost position, the terminal part 32A and the fixed part 32D are placed in the second and third leftmost positions respectively, and the origin part 32B is placed in the rightmost position along the widthwise direction 9. Meanwhile, when the carriage 23 is at the right-side end along the widthwise direction 9, as depicted in FIG. 4, the ink tube 32 is beaded to place the fixed part 32D, the extending part 32C, the terminal part 32A, and the origin part 32B to be arranged, from left to right, in the order of being mentioned. In other words, the fixed part 32D is placed in the leftmost position, the extending part 32C and the terminal part 32A are placed in the second and third leftmost positions respectively, and the origin part 32B is placed in the rightmost position along the widthwise direction 9.

A beaded part of the ink tube 32, including the extending part 32C, which is indicated by hatching in FIG. 3, is bended approximately in a shape of "C" or overturned "U" Meanwhile, a beaded part of the ink tube 32 including the extending part 32C, which is indicated by hatching in FIG. 4, is rather extended in a linear shape compared to the beaded part shown in FIG. 3. In other words, curvature of the bended part in the ink tube 32 is greater when the carriage 23 is in the left-side end along the widthwise direction 9 than when the carriage 23 is in the right-side end along the widthwise direction 9. Thus, a restoration force, by which the ink tube 32 tends to restore to the original straight shape, produced in the ink tube 32 when the ink tube 32 is in the "C" posture shown in FIG. 3 is greater compared to the restoration force produced in the ink tube 32 when the ink tube 32 is in the linear posture shown in FIG. 4.

Due to the greater restoration force, the carriage 23 in the posture shown in FIG. 3 is subjected to a force, which tends to lift the carriage 23 upward, i.e., a force to separate the carriage 23 apart from the sheet 14 held on the platen 42, from the ink tube 32, which tends to restore to the original shape. More specifically, the carriage. 23 is urged downward by a force from the ink tube 23 at a position of the extending part 32C. In this regard, however, while the carriage 32 is supported by the guide rail 4, the carriage 23 is prevented from being moved downward. In the meantime, the carriage 23 is urged rearward by a force from the ink tube 32 at a position of the first end 32. Due to combination of the directions of the forces from the ink tube 32, the carriage 23 is urged in a direction to be uplifted with the extending part 32C being a base point. Meanwhile, the curvature of the beaded part in the ink tube 32 is decreased to be smaller as the carriage 23 is moved in the reverse orientation RVS. In other words, intensity of the urging force to be applied to the carriage 23 to uplift the carriage 23 is the greatest when the carriage 23 is at the left-side end and is decreased to be smaller as the carriage 23 moves rightward from the left-side end in the reverse orientation RVS.

[Flexible Flat Cable 33]

The flexible flat cable 33 is a belt-shaped signal cable and connects a controller board (not shown) fixed in the printer part 11 with a recording head board (not shown) mounted on the carriage 23 electrically. In the flexible flat cable 33, a plurality of conductive wires to transmit electrical signals are aligned in line along a direction of breadth thereof and are covered with synthetic resin film such as polyester film. The flexible flat cable 33 is, as well as the ink tube 32, flexible and resiliently deformable to follow the reciprocating carriage 23 smoothly. The flexible flat cable 33 can be bended similarly to the ink tube 32 according to the positions of the carriage 23. Therefore, curvatures of the flexible flat cable 33, which vary according to the positions of the carriage 23, are substantially the same as those of the ink tube 32.

[Purging Unit 50A]

A purging unit 50A (see FIG. 3) is disposed in a rightward end position within a movable range of the carriage 23 along the widthwise direction 9, which is on a right-hand side of a reciprocating range for the carriage 23. In other words, while the carriage is movable to reciprocate within an image recordable range during an image recording operation, the purging unit 50A is disposed further rightward in the position beyond the image recordable range. The purging unit 50A provides a purging operation to the recording head 40. By the purging operation, air bubbles and obstacles in the nozzles 40 of the recording head 39 are removed therefrom along with residual ink. In the purging operation, the recording head 39 is placed to the rightward end position to face the purging unit 50A, and the nozzle surface of the recording head 39 is covered by a cap (not shown). Thereafter, a pump (not shown) is activated by the conveyer motor 102, and negative pressure is generated in a sealed area enclosed by the nozzle surface and the cap. Therefore, by the negative pressure, the air bubbles and the obstacles are sucked along with the residual ink and removed from the nozzles 40. The removed ink and the obstacles are conveyed to a waste ink tank (not shown).

[Waste Ink Tray 50B]

A waste ink tray 50B (see FIG. 4) is disposed in a leftward end position within the movable range of the carriage along the widthwise direction 9, which is on a left-hand side of the reciprocating range for the carriage 23. In other words, the waste ink tray 50B is disposed further leftward in the position beyond the image recordable range. The waste ink tray 50B is formed to open at a top, and when the recording head 50B is placed in the leftward end position to face the waste ink tray 50B, ink discharged out of the recording head 39 during a flushing operation can be received in the waste ink tray 50B. In the flushing operation, the recording head 39 discharges ink through the nozzles 40 toward the waste ink tray 50B. Thereby, ink dried in the nozzles 40 and thickened can be removed out of the nozzles 40 and caught in the waste ink tray 50B.

[Controller 130]

Figure 5:
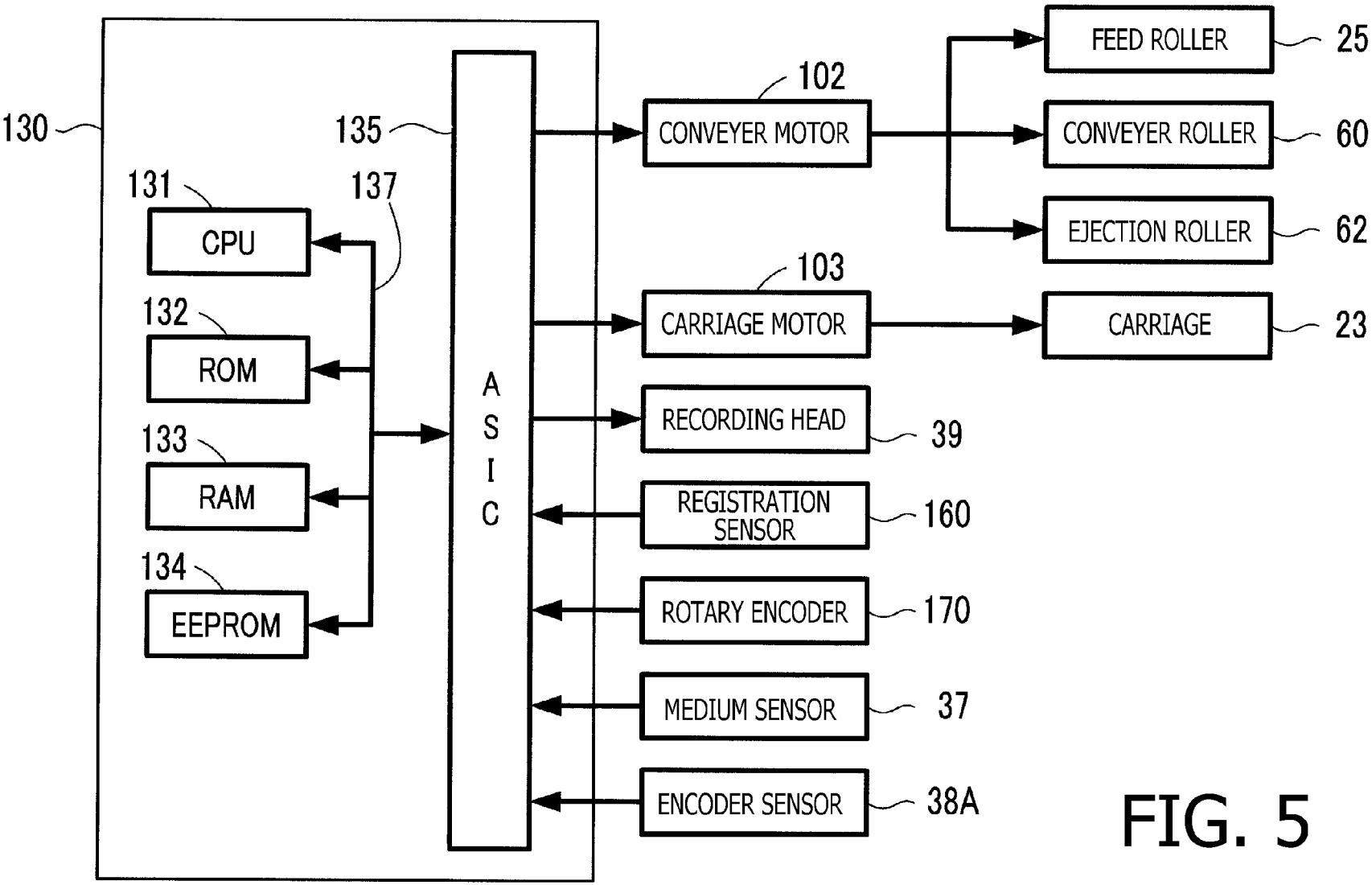
FIG. 5 is a block diagram to illustrate configurations of a controller 130 and other related parts in the MFD 10 according to the embodiment of the present invention.

As depicted in FIG. 5, the controller 130 mounted on the controller board includes a CPU (central processing unit) 131, a ROM (read-only memory) 132, a RAM (random access memory) 133, an ERPROM (electrically erasable programmable read-only memory) 134, and an ASIC (application specific integrated circuits) 135, which are connected with one another by internal busses 137. The ROM 132 stores programs to control behaviors of the CPU 131. The RAM 133 is used as a memory area to temporarily store data and signals to be used in cooperation with the programs stored in the ROM 132 and as a work area to process the data. The EEPROM 134 stores data, such as configuration data and flags, which is to be saved even after power to the controller 130 is shut down.

The ASIC 135 is connected with the conveyer motor 102 and the carriage motor 103. The ASIC 135 obtains driving signals to drive the conveyer motor 102 and the carriage motor 103 from the CPU 131 and outputs driving current to the conveyer motor 102 and the carriage motor 103 according to the driving signals. The conveyer motor 102 and the carriage motor 103 are driven in a normal or reverse rotation by the driving current. For example, the controller 130 may control the conveyer motor 102 to rotate the rollers. At the same time, the controller 130 may control the carriage motor 103 to reciprocate the carriage 23. Further, the controller 130 may control the recording head 39 to discharge the ink through the nozzles 40.

The ASIC 135 is electrically connected with the registration sensor 160, the rotary encoder 170, the medium sensor 37, and the encoder sensor 38A. Based on the detected signals output from the registration sensor 160 and the pulse signals output from the rotary encoder 170, the controller 130 detects a position of the sheet 14 in the conveying path 65. Further, based on the pulse signals obtained from the encoder sensor 38A, the controller 130 detects a position of the carriage 23 along the widthwise direction 9. Further, the controller 130 detects brightness on the sheet 14, i.e., an image recorded on the sheet 14, based on the signals obtained from the medium sensor 37,

[Image Recording Operation (Discharging Timing Controlling Operation)]

Figure 6:
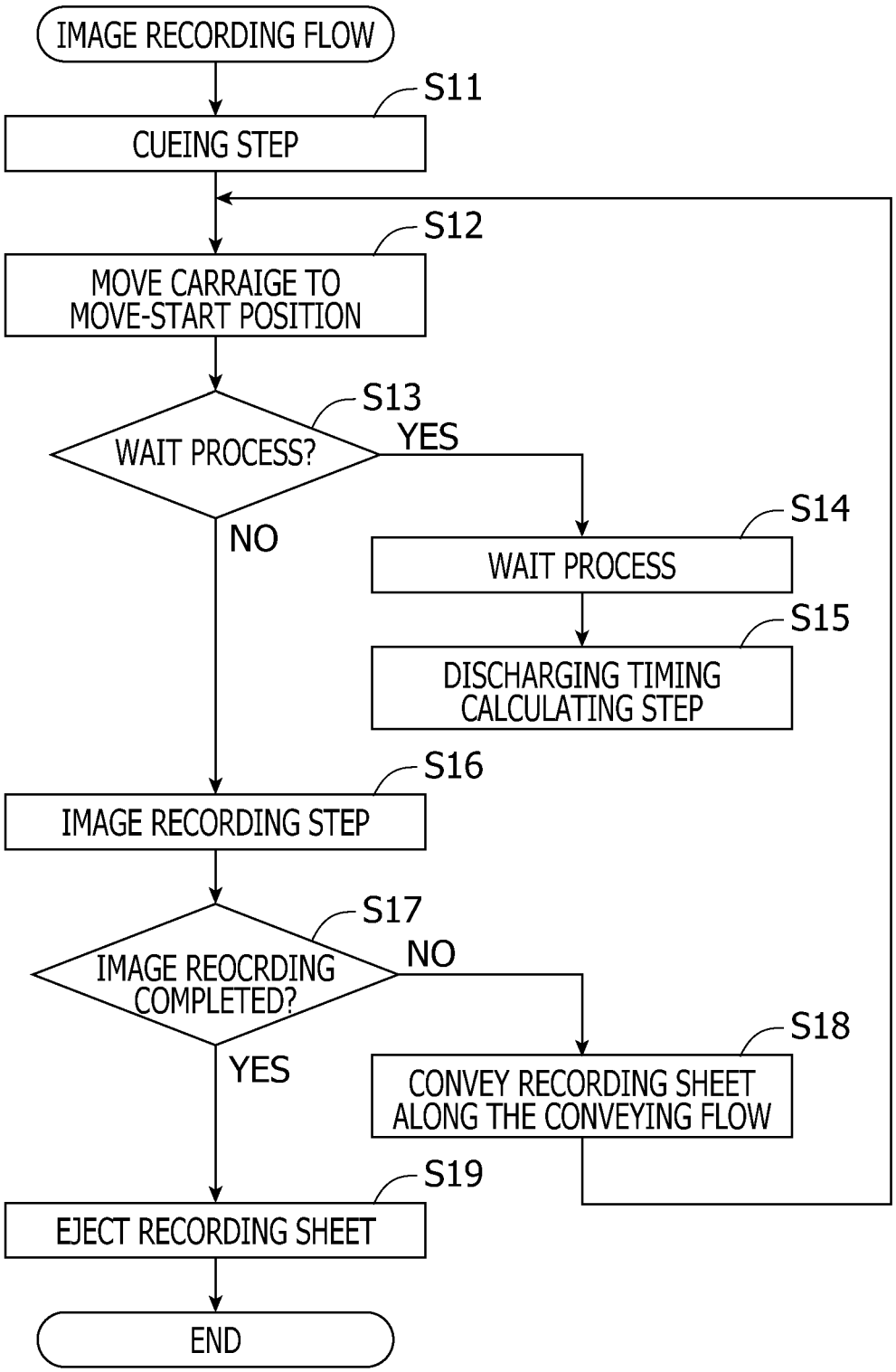
FIG. 6 is a flowchart to illustrate a flow of an image recording operation to be performed by the controller 130 in the MFD 10 according to the embodiment of the present invention.

With reference to FIGS. 6-8, a flow of an image recording operation executed by the MFD 10 will be described herein below, in the image recording operation, the image is recorded on the sheet 14 by discharging the ink from the recording head 39. Timings to discharge the ink at the sheet 14 are controlled in consideration of deviated amounts, which will be described later in detail. The deviated amounts are stored in the EEPROM 134. The image reading operation and other flows of operations described below may be executed by the CPU 131 reading the program from the ROM 132 or may be achieved by hardware circuits mounted on the controller 130.

As the flow starts, in S11, based on an image recording instruction entered by a user, the controller 130 executes a cueing step. According to the image recording instruction, the controller 130 manipulates the rollers, the carriage 23, and the recording head 39 to record an image on the sheet 14. The image recording instruction may be obtained through, but not limited to, an operation panel 17 provided in the MFD 10, for example. For another example, the instruction may be entered from an external device (not shown) through a communication network.

In the cueing step, the sheet 14 stored in the feeder tray 20 is conveyed to the position to face the recording head 39. More specifically, the controller 130 feeds the sheet 14 from the feeder tray 20 to the conveyer path 65 by activating the conveyer motor 102 to rotate in one direction and thereby manipulating the feeder unit 15. When a leading edge of the sheet 14 reaches the conveyer roller unit 54, the controller 130 conveys the sheet 14 to a position, where the sheet 14 and the recording head 39 confront each other, by switching the conveyer motor 102 to rotate in an opposite direction and thereby manipulating the conveyer roller unit 54. The controller 130 may determine that the sheet 14 reaches the conveyer roller unit 54 and the confronting position based on combination of the detected signals output from the registration sensor 160 and the pulse signals output from the rotary encoder 170.

Following S11, in S12, the controller 130 moves the carriage 23 to a move-start position. In the first embodiment, the move-start position is the leftward end within the movable range of the carriage 23 and may be, for example, the position to face the waste ink tray 50B. In particular, the controller 130 drives the carriage motor 103 and thereby moves the carriage 23 in the forward orientation FWD to the move-start position. If the carriage 23 is already in the move-start position, the flow skips S12 and proceeds to S13. The controller 130 judges the position of the carriage 23 based on the pulse signals from the encoder sensor 38A.

In S13, the controller 130 determines whether any "wait" process should be applied to the carriage 23 at the move-start position. The wait process includes processes and operations which should be applied to the carriage 23 while the carriage 23 is halted at the move-start position. For example, the flushing operation may be performed in S13 as a part of the wait process. For another example, a dry-wait operation may be performed in S13 as a part of the wait process. The dry-wait operation may be applied to the sheet 14 when an amount of the ink discharged to the image recordable range in a preceding image recording step (S16) exceeds a predetermined threshold amount, and when the dry-wait operation is performed, a next image recording step (S16) is suspended for a predetermined waiting period. For another example, when the cueing step (S11) is to be applied to the carriage 23 pausing at the move-start position, the cueing may be included as a part of the wait process. For another example, during a double-face image recording operation, an operation to place a reverse side of the sheet 14 in the position to face the recording head 39, after an image is completely recorded on an obverse side of the sheet 14, may be included as a part of the wait process.

If the controller 130 determines that a wait process is to be applied to the carriage 23 while the carriage 23 is at the move-start position, in S13, further, the controller 130 estimates duration of time required for the wait process. In this regard, the duration is equivalent to a pausing period, in which the carriage 23 is maintained motionless at the move-start position. In other words, the controller 130 obtains the pausing period for the carriage 23 to be halted at the move-start position. The pausing period may be measured by a timer (not shown) installed in the controller 130 while the wait process is executed or may be obtained from the EEPROM 134, which may store the pausing periods in association with each applicable wait process. The EEPROM 134 may not necessarily store the pausing periods but may store information, which can identify lengths of the pausing periods, and the controller 130 may specify the pausing period based on the information. If the controller 130 determines that the process should be applied to the carriage 23 at the move-start position (S13: YES), the flow proceeds to S14, and the controller 130 executes the necessary wait process while the carriage 23 is maintained at the move-start position.

Following S14, in S15, the controller 130 calculates discharging timings to discharge the ink in an image recording step (S516), which will be described below, based on the pausing period obtained in S13. According to the calculation in S15, the discharging timings are advanced from original timings to be earlier as a longer pausing period is provided, and as a shorter distance between the move-start position and discharging positions is provided. In other words, the longer the carriage 23 pauses, and the shorter the distance between the move-start position and the discharging position for the carriage 23 is, the earlier the discharging timing is advanced from the original discharging timing. The discharging timing calculating step (S15) will be described below with reference to FIGS. 7 and 8.

FIG. 7 illustrates relative positions of trajectories 110, 111, 112 for the carriage 23 and the sheet 14. The trajectory 110 indicates a moving path for the carriage 23, which has experienced the pausing period of 10 milliseconds or shorter in S13. When the pausing period is as short as 10 milliseconds, or shorter, e.g., when the carriage 23 moved in the forward orientation FWD to the move-start position is immediately switched to move in the reverse orientation RVS, an amount of the gap between the recording head 39 and the sheet 14 is substantially constant along the widthwise direction 9 while the carriage 23 travels along the widthwise direction 9. Therefore, discharging timings D0 to discharge the ink from the recording head 39 toward targeted positions L1, L2, L3, L4, which are spaced apart from one another along the widthwise direction 9, are constant.

In this regard, the discharging timings D0 indicate that the ink targeted at the targeted positions should be discharged from the recording head 39 D0 second(s) before the carriage 23 reaches positions straight above the targeted positions. In other words, the discharging timings D0 indicate time periods, which are required for the ink droplets discharged at discharging positions E1, E2, E3, E4 respectively to travel through the gap between the recording head 39 and the sheet 14 until the ink droplets land on the targeted positions L1, L2, L3, L4 on the sheet 14 respectively. Further, in other words, the discharging timings D0 indicate time periods, which are required for the carriage 23 to move from the discharging positions E1, E2, E3, E4 to travel to the positions straight above the targeted positions L1, L2, L3, L4 respectively. In S13, when the controller 130 recognizes the wait process to be applied to the carriage 23, but the pausing period obtained in S13 is 10 milliseconds or shorter, the controller 130 considers that no wait process is performed (S13: NO) and skips S14-S15. The flow proceeds to S16, and the image recording step is performed. Therefore, the controller 130 manipulates the carriage 23 and the recording head 39 to discharge the ink toward the targeted positions L1, L2, L3, L4 when the carriage 23 is at the discharging positions E1, E2, E3, E4 respectively.

The trajectory 111 in FIG. 7 indicates a moving path for the carriage 23, which has experienced the pausing period of 1000 milliseconds in S13. As mentioned above, the carriage 23 pausing at the move-start position is urged by the resiliency of the ink tube 32 in the direction to be uplifted. Therefore, the amount of the gap between the recording head 39 and the sheet 14 is increased to be greater as the carriage 23 pauses for the longer period. In other words, the longer period the carriage 23 pauses at the move-start position, the greater the amount of the gap between the recording head 39 and the sheet 14 is increased. In this regard, the influence of the resiliency of the ink tube 32 is reduced to be smaller as the farther distance the carriage 23 is separated from the move-start position. In other words, the tarter the carriage 23 is carried away from the move-start position, the smaller the influence of the resiliency of the ink, tube 32 is reduced. Therefore, the amount of the gap between the recording head 39 and the sheet 14 in the trajectory 111 is increased to be greater as the distance between the move-start position and the carriage 23 is shortened. On the other hand, the amount of the gap between the recording head 39 and the sheet 14 in the trajectory 111 is decreased to be smaller as the distance between the move-start position and the carriage 23 is enlarged. In this regard, at rightward positions with respect to the discharging position E4, i.e., at downstream portions, along the reverse orientation RVS, the trajectories 110, 111, 112 coincides with one another. In other words, the influence of the resiliency of the ink tube 32 is negligibly small at the downstream portions of the trajectories 110, 111, 111 along the reverse orientation RVS. This is because that the curvature of the bended part of the ink tube 32 is reduced to be smaller as the carriage 23 is moved to the downstream along the reverse orientation RVS. In other words, the urging force to uplift the carriage 23 from the ink tube 32 is reduced to be smaller as the carriage 23 is separated farther away from the leftward end along the reverse orientation RVS.

In S15, therefore, the controller 130 calculates the discharging timing for the ink to be ejected to land on the landing positions L1-L4 with reference to the correspondence (see FIG. 8) between the pausing periods and the deviated amounts of the landing positions with respect to the targeted positions. As mentioned above, the correspondence shown in FIG. 8 may be stored, for example, in the EEPROM 134. The deviated amounts shown in FIG. 8 indicate distances between the landing position of the ink discharged at the seine discharging timings from the recording head 39 mounted on the carriage 23, which starts moving after experiencing the pausing periods of 10 milliseconds, 50 milliseconds, 100 milliseconds, . . . , and 1000 milliseconds, and the targeted positions respectively.

Therefore, for example, the deviated amounts of the landing position of the ink discharged from the recording head 39 on the carriage 23, which starts moving from the move-start position after being halted for the pausing period of 10 milliseconds, indicate all zero (0) millimeters (mm). For another example, the deviated amount $\alpha 1$ indicates that the ink discharged from the recording head 39 on the carriage 23, which starts moving from the move-start position after being halted for the pausing period of 50 milliseconds, at the discharging position E1 lands on an $\alpha 1$ millimeters rightward landing position, i.e., $\alpha 1$ millimeters downward position along the reverse orientation RVS, with respect to the landing position of the ink discharged from the recording head 39 on the carriage. 23, which starts moving after being halted for the pausing period of 10 milliseconds or shorter. The other deviated amounts $\alpha 2$, $\alpha 3$, $\beta 1$, $\beta 2$, $\beta 3$ . . . are interpreted in the same manner in the present embodiment.

In this regard, the deviated amount $\alpha$ with respect to the targeted position L1 is increased to be greater as the longer pausing period is provided. (i.e., $0<\alpha 1<\alpha 2<\alpha 3$). In other words, the longer the carriage 23 pauses at the move-start position, the greater the deviated amount $\alpha$ becomes. The deviated amount $\beta$ with respect to the targeted position L3 is increased to be greater in the same manner as the longer pausing period is provided (i.e., $0<\beta 1<\beta 2<\beta 3$). Meanwhile, the deviated amount with respect to a specific length of pausing period (e.g., 50 milliseconds) is decreased to be smaller as the distance between the move-start position and the targeted position is enlarged to be greater. That is, if the same length of pausing period is provided, the greater the distance between the move-start position and the targeted position is, the smaller the deviated amount becomes (i.e., $\alpha 1>\beta 1>0$). Thus, the deviated amount with respect to the targeted position L4 is zero (0). A method to obtain the deviated amounts will be described later in detail.

In S15, the controller 130 reads the deviated amounts associated with the pausing period obtained from the EEPROM 134 in S14. For example, if the obtained pausing period is 1000 milliseconds, the deviated amounts ($\alpha 3$, $\beta 3$, 0) are obtained from the EEPROM 134. Thereafter, the controller 130 divides the obtained deviated amounts by a moving velocity V of the carriage 23, at which the carriage 23 is to be moved in the image recording step in S16, respectively. Thus, deviated lengths of periods (i.e., $\alpha 3/V$, $\beta 3/V$, 0) deviated from the reference discharging timing are obtained. The moving velocity V of the carriage 23 is a speed of the carriage 23 to be constantly moved in the position to face the sheet 14. The moving velocity V of the carriage 23 may be stored in the EEPROM 134. Alternatively, the controller 130 may obtain a recent moving velocity V of the carriage 23 based on the pulse signals output from the encoder sensor 38A.

Thus, the controller 130 calculates corrected discharging timings, which are advanced to be earlier for the deviated lengths of periods from the reference discharging timing D0 for the targeted positions L3, L3, L4. In other words, when the pausing period for the carriage 23 to be halted at the move-start position is 1000 milliseconds, a discharging timing for the recording head 39 to discharge the ink toward the targeted position L1 is ($D0+\alpha 3/V$), and discharging timings for the recording head 39 to discharge the ink toward the targeted positions L3, L4 are ($D0+\beta 3/V$) and D0 respectively.

Meanwhile, according to FIG. 8, deviated amounts with regard to the targeted position. L2 are not stored in the EEPROM 134. Therefore, the controller 130 calculates the deviated amount for the ink to be discharged toward the targeted position L2 by linearly interpolating in between the deviated amounts with respect to the targeted positions L1, L3, which adjoin the targeted position L2 along the widthwise direction 9, among the deviated amounts for the targeted positions L1, L3, L4 stored in the EEPROM 134.

In other words, the controller 130 linearly interpolates the deviated amount for the targeted position L2 between the deviated amount $\alpha 3$ for the targeted position L1, which is at an upstream adjoining position with respect to the targeted position L2 along the reverse orientation RVS, and the deviated amount $\beta 3$ for the targeted position L3, which is at a downstream adjoining position with respect to the targeted position L2 along the reverse orientation RVS, in consideration of the relative position among the targeted positions L1, L2, L3. For example, if the targeted position L2 is in a midst position between the targeted position L1 and the targeted position L3 along the widthwise direction 9, the deviated amount for the targeted position L2 $(\alpha 3+\beta 3)/2$ is obtained by averaging. Thereby, a corrected discharging timing ($D0+(\alpha 3+\beta 3)/2V$), at which the ink should be discharged toward the targeted position L2, is obtained.

Following S15, in S16, the controller 130 executes the image recording step, in which an image is recorded by discharging the ink onto the sheet 14 according to the corrected discharging timings obtained in the discharging timing obtaining step in S15. In particular, the controller 130 activates the carriage motor 103 to move the carriage 23 from the move-start position in the reverse orientation RVS along the widthwise direction 9. While the carriage 23 is moved along the widthwise direction 9, the controller 130 manipulates the recording head 39 to discharge the ink toward the targeted positions L1, L2, L3, L4 on the sheet 14 at the corrected discharging timings obtained in the discharging timing calculating, step (S15).

For example, after being halted for 1000 milliseconds at the move-start position, the recording head 39 on the carriage 23 discharges the ink toward the targeted position L1 when the carriage 23 is in the discharging position E1', i.e., at the corrected discharging timing $D0+\alpha 3/V$. Further, the recording head 39 discharges the ink toward the targeted position L2 when the carriage 23 is in the discharging position E2', i.e., at the corrected discharging timing $D0+(\alpha 3+\beta 3)/2V$. Thereafter, the recording head 39 discharges the ink toward the targeted position L3 when the carriage 23 is in the discharging position E3', i.e., at the corrected discharging timing D0+β3/V. Thereafter, the recording head 39 discharges the ink toward the targeted position L4 when the carriage 23 is in the discharging position E4, i.e., at the discharging timing D0.

Following S16, in S17, the controller 130 judges whether an entire image for the image recording instruction is completely recorded on the sheet 14. If image recording is not completed (S17: NO), in S18, the controller 130 manipulates the conveyer motor 102 to rotate for a predetermined amount so that at least one of the conveyer roller unit 54 and the ejection roller unit 55 is driven to convey the sheet 14 for a predetermined linefeed amount. Thus, steps S12-S18 may be repeated for a plurality of times until the entire image for the image recording instruction is completely recorded. When the entire image is completely recorded on the sheet 14 (S17: YES), in S19, the controller 130 ejects the sheet 14 in the dejection tray 21. In particular, the controller 130 manipulates the conveyer motor 102 to rotate for a predetermined amount. Thus, the sheet 14 is conveyed to the ejection tray 20 by the ejection roller unit 55 and ejected from the MFD 1.

In the EEPROM 134, it is noted that every deviated amount may not necessarily be stored in association with the pausing period. For example, in the present embodiment, a pausing period of 75 milliseconds is not in the table stored in the EEPROM 134. If the pausing period obtained in S14 indicates 75 milliseconds, the carriage 23 may be moved in the trajectory 112 indicated in FIG. 7, in this regard, the controller 130 linearly interpolates a deviated amount with regard to the pausing period of 75 milliseconds between the pausing periods of 50 milliseconds and 100 milliseconds, which temporally adjoin the pausing period of 75 milliseconds in the table shown in FIG. 8, among the pausing periods stored in association with the deviated amounts in the EEPROM 134. Thus, the deviated amount (α2+α1)/2 to land on the targeted position L1, the deviated amount (β2+β1)/2 to land on the targeted position L3, the deviated amount 0 to land on the targeted position L4 are obtained. Further, according to the linear interpolation, the deviated amount (α2+α1+β2+β1)/4 to land on the targeted position L2 is obtained.

Accordingly, after being halted for 75 milliseconds at the move-start position, in S16, the recording head 39 discharges the ink toward the targeted position L1 when the carriage 23 is in the discharging position E1", i.e., at the corrected discharging timing D0+(α2+α1)/2V. Thereafter, the recording head 39 discharges the ink toward the targeted position L2 when the carriage 23 is in the discharging position E2", i.e., at the corrected discharging timing D0+(α2+α1+β2+β1)/4V. Further, the recording head 39 discharges the ink toward the targeted position L3 when the carriage 23 is in the discharging position E3", i.e., at the corrected discharging timing D0+(β2+β1)/2V. Thereafter, the recording head 39 discharges the ink toward the targeted position L4 when the carriage 23 is in the discharging position E4 at the discharging timing D0.

[Usability of the First Embodiment]

According to the first embodiment described above, the discharging timings to discharge the ink from the recording head 39 are advanced from the discharging timing D0 in accordance with the length of the pausing period for the carriage 23 to pause at the move-start position. Therefore, the discharged ink can land on the targeted positions correctly. Thus, the undesirable deterioration of image recording quality due to the influence of the resiliency of the ink tube 32 can be reduced. In this regard, the deviated amount for the landing position with respect to the targeted position becomes greater as the longer pausing period is provided and as the longer distance the discharging position is distanced apart from the move-start position. Accordingly, with a plurality of applicable pausing periods and the deviated amount with respect to the targeted position stored in association with one another in the EEPROM 134, the ink can be discharged at the sheet 14 to land on the targeted positions correctly. In other words, the landing position of the discharged ink coincides with the targeted position.

According to the first embodiment, the more quantity of deviated amounts are stored in the EEPROM 134, the more accurately the discharging timings can be corrected. However, in order to store a larger quantity of the deviated amounts, a larger volume of EEPROM 134 is required. Therefore, in the first embodiment described above, only the deviated amounts corresponding to the temporally dispersed pausing periods and the dispersed targeted positions are stored in the EEPROM 134, and the intervening deviated amounts in between the stored deviated amounts are omitted from the EEPROM 134. However, the intervening deviated amounts may be achieved by the interpolation. Thus, the discharging timings can be accurately corrected while the volume of the EEPROM 134 may be prevented from being increased.

Meanwhile, the information to be stored in the EEPROM 134 may not necessarily be limited to the deviated amounts but may be, for example, the deviated lengths of time periods or the corrected discharging timings with respect to the discharging timing D0. Further, in the first embodiment described above, as examples of interpolation of the deviated amounts, interpolation of the intermediate targeted position L2 and the intermediate pausing period 75 milliseconds are explained. However, the parameters to be interpolated may not necessarily be the deviated amounts. For example, a deviated length of period with respect to the discharging timing D0 may be interpolated based on adjoining deviated lengths of periods. Furthermore, the intermediate deviated amount may not necessarily be linearly interpolated but may be interpolated by other interpolating functions such as an n-dimensional function (n being an integer greater than or equal to 2) and a logarithm function. The interpolating functions may be suitably adopted by a manufacturer or an engineer in consideration of various factors including the pausing periods for the carriage 23 and timely-changing amount of the gap between the recording head 39 and the sheet 14 while the carriage 23 is being moved.

According to the first embodiment described above, the discharging timing calculating step may be particularly beneficial when the cartridge, mount 30 and the carriage, 23 are connected by the ink tube 32 with intense rigidity. In this regard, however, while the carriage 23 may be urged to be uplifted not only by the ink tube 32 but also by the flexible flat cable 33, the present embodiment may be similarly effectively applied to an inkjet recording apparatus, in which the ink cartridge is mounted on the carriage 23, i.e., an inkjet recording apparatus, in which no ink tube 32 is required.

Second Embodiment

Next, with reference to FIGS. 7 and 9-10, a flow of steps to be executed by the MFD 10 according to a second embodiment of the present invention will be described below. The configuration of the MFD 10 is, unless otherwise noted, the same as that of the MFD 10 described in the first embodiment. In the following description, a method to calculate and set the pausing periods and the deviated amounts corresponding to the targeted positions, which are stored in the EEPROM 13 as shown in FIG. 8, will be explained.

As the flow starts, in S21, based on a deviated amount setting instruction entered by the user, the controller 130 executes the cueing step, which is similar to S11 in the image recording flow shown in FIG. 6. Description of the cueing step is herein omitted. Based on the deviated amount setting instruction, the controller 130 manipulates at least a part of the MFD 10 to obtain the deviated amounts of the landing positions of the ink, which are caused by the carriage 23 pausing at the move-start position, and store the obtained deviated amounts in the EEPROM 134. The deviated amount setting instruction may be obtained through, but not limited to, the operation panel 17 provided in the MFD 10 or from an external device (not shown), similarly to the image recording instruction. Following S21, in S22, the controller 130 records a pattern image, which includes a first image 121 and second images 122, 12.3, 124 shown in FIG. 10, on the cued sheet 14. The first image 121 and the second images 122, 123, 124 are line segments, which intersect with the widthwise direction 9. In particular, in the example shown in FIG. 10, the line segments intersect with the widthwise direction 9 orthogonally. A first image 125, a second image 126, a third image 127, and a fourth image 128, which will be described later in detail, are also line segments intersecting with the widthwise direction 9 orthogonally.

In S22, more specifically, the controller 130 performs a first recording step to record first images 121A, 121B, 121C on the cued sheet 14. In this regard, the controller 130 moves the carriage 23, which has paused at the move-start position for a pausing period of 10 milliseconds or shorter, in the reverse orientation RVS along the widthwise direction 9. While the carriage 23 is moved in the reverse orientation RVS, the controller 130 manipulates the recording head 39 to discharge the ink at the discharging positions E1, E3, E4 (see FIG. 7) at the discharging timing D0. Thereby, the first images 121A, 121B, 121C are recorded at the targeted positions L1, L3, L4 respectively on the sheet 14 in positions separated apart from one another along the widthwise direction 9. The discharging positions E1, E3, E4 are, but not necessarily limited to, evenly spaced apart from one another.

Following S22, in S23, the controller 130 moves the carriage 23 in the forward orientation FWD to return to the move-start position and maintains the carriage 23 to pause thereat for one of the predetermined pausing periods (e.g., 50 milliseconds). In S24, the controller 130 conveys the sheet 14 for the predetermined linefeed amount, similarly to S18 in FIG. 9. The detailed behavior of linefeed conveyance is herein omitted. It is noted that S23 and S24 may not necessarily be performed in the order as shown in FIG. 9 but may be performed in a reversed order (S24, S23) or may be performed simultaneously.

Following S24, in S25, the controller performs a second recording step to record second images 122A, 122B, 122C on the sheet 14 conveyed for the predetermined linefeed amount. The procedure to record the second images 122A, 122B, 122C in the second recording step is similar to the procedure, in the first recording step. Therefore, the controller 130 moves the carriage 23, which experienced the one of the pausing periods (e.g., 50 milliseconds) at the move-start position, in the reverse orientation RVS along the widthwise direction 9. While the carriage 23 is moved in the reverse orientation RVS, the controller 130 manipulates the recording head 39 to discharge the ink at the discharging positions E1, E3, E4 (see FIG. 7) at the discharging timing D0. Thereby, the second images 122A, 122B, 122C are recorded on the sheet 14.

Following S25, in S26, the controller 130 judges whether the carriage 23 experienced prior to the second recording step each one of the predetermined pausing periods. If the carriage 23 has not experienced each one of the predetermined pausing periods (S26: NO), the controller 130 sets a next one of the predetermined pausing periods and returns to S23. Thereafter, the controller 130 repeats S23-S27 until the carriage 23 experiences each one of the predetermined pausing periods and the second recording step, in the example shown in FIG. 8, therefore, after experiencing the pausing period of 50 milliseconds, the carriage 23 experiences the pausing periods of 100 milliseconds and 1000 milliseconds sequentially. As a result, after experiencing the pausing period of 100 milliseconds, i.e., after the carriage 23 paused for the pausing period of 100 milliseconds at the move-start position, in S25, second images 123A, 123B, 123C are recorded on the sheet 14. Thereafter, after experiencing the pausing period of 1000 milliseconds, i.e., after the carriage 23 paused for the pausing period of 1000 milliseconds at the move-start position, in S25, second images 124A, 124B, 124C are recorded on the sheet 14.

The second images 122, 123, 124 are recorded on the sheet 14 in positions separated apart from one another along the widthwise direction 9. Meanwhile, the first image 121 and the second images 122, 123, 124 are recorded in the ink discharged from the recording head 39 at the same discharging timings and at the same discharging positions E1, E3, E4 respectively. However, due to the longer pausing period in S23 for the carriage 23 to pause at the move-start position prior to the second recording step (S25), the second images 122, 123, 124 are recorded in downstream deviated positions along the reverse orientation RVS with respect to the first image 121 recorded in the first recording step (S22), which experienced the shorter pausing period of at most 10 milliseconds.

Meanwhile, distances between the first image 121 and the second images 122, 123, 124 are smaller as the second images 122, 123, 124 are spaced apart farther from the move-start position. In other words, the farther the second images are separated apart from the move-start position along the widthwise direction 9, the narrower the distances between the first image 121 and the second images 122, 123, 124 are. In this regard, the second images 122C, 123C, 124C are recorded on the same widthwise position, i.e., at the targeted position L4, as the first image 121C along the widthwise direction 9. Meanwhile, the second images 122, 123, 124, which are recorded in the ink discharged at the same widthwise positions along the widthwise direction 9, are recorded in the positions separated farther apart from the first image 121 as the experienced pausing period is longer. In other words, the longer the experienced pausing period is, the farther the second images 122, 123, 124 are separated from the first image 121.

In S26, if the second recording step has experienced each one of the predetermined pausing periods (S26: YES), in S28, the controller 130 performs a reading step. In the reading step, the controller 130 manipulates the scanner part 12 to read the sheet 14, on which the first image 121 has been recorded in the first recording step and the second images 122, 123, 12 have been recorded in the second recording step. According to the read images, the scanner part 12 generates image data. Thereafter, in S29, the controller 130 measures deviated amounts of the second images 122, 123, 124 with respect to the first image 121 along the widthwise direction 9 based on the image data generated by the scanner part 12 and stores the measured deviated amounts in the EEPROM 134. In this regard, the positions of the images in the image data may be measured by, for example, by scanning the images along the moving direction of the carriage 23 to obtain brightness of each pixel in the images and detecting edge positions, at which the brightness changes abruptly.

Thus, the controller 130 measures the deviated amount within each pair of the first image 121 and one of the second image 122, 123, 124, which are recorded in the ink discharged at the same discharging position. That is, within a pair of the first image 121A and the second image 122A, a distance between the first image 121A and the second image 122A along the widthwise direction 9 indicates a deviated amount α1. Within a pair of the first image 121B and the second image 122B, a distance between the first image 121B and the second image 122B indicates a deviated amount β1. Within a pair of the first image 121C and the second image 122C, a distance between the first image 121C and the second image 122C indicates a deviated amount zero (0). Similarly, deviated amounts within pairs of the first image 121 and the second image 123 and of the first image 121 and the second image 124 are measured. Thus, the deviated amounts shown in FIG. 8 are obtained and set in the EEPROM 134.

[Usability of the Second Embodiment]

According to the second embodiment described above, without using an external apparatus, such as a scanning apparatus, the MFD 10 can solely perform the deviated amount setting operation. While the force from the ink tube to affect the carriage 23 may vary among individual MFDs 10 and/or depending on rigidity of the ink tube 23, which may vary across ages, by performing the deviated amount setting operation in the MFD 10, the discharging timings can be controlled properly based on the timely corrected discharging timings.

The reading step in S28 may be performed, for example, by use of the medium sensor 37 in place of the scanner part 12. In other words, the reader unit may be any kind of device as long as the device can optically recognize the first image 121 and the second images 122, 123, 124. Even more, the reading step may not necessarily be performed in the MFD 10. For example, an external device may read the first image 121 and the second images 122, 123, 124 and generate the image data concerning the read images, and the MFD 10 may obtain the image data from the external device. Thus, the MFD 10 can perform the deviated amount setting operation based on the externally obtained image data.

According to the embodiment described above, the farther the second images 122, 123, 124 are separated apart from the move-start position along the widthwise direction 9, the smaller the deviated amount between the first image 121 and the second images 122, 123, 124 become. Meanwhile, the longer pausing period the carriage 23 experiences, the larger the deviated amounts between the first image 121 and second images 122, 123, 124 become. Therefore, by recording the first image 121 and the second images 122, 123, 124, which are separated apart from one another along the widthwise direction 9 in the first recording step and the second recording step respectively, and by experiencing each one of the pausing periods prior to repeating the second recording step for a plurality of times, a plurality of patterns of deviated amounts are obtained. Thus, the discharging timings can be preferably controlled to absorb the deviated amounts. When the different lengths of pausing periods are experienced prior to repeating the second recording step, as shown in FIG. 10, it ma be effective, but not necessarily, that the shorter pausing periods are experienced earlier and the longer pausing periods are experienced later. Iii other words, the more the second recording step is repeated, the pausing period may be incremented to be longer.

According to the second embodiment described above, with the conveying step in S24, the first image 121 and the second images 122, 123, 124 are recorded in the positions displaced from one another along the front-rear direction 8. Therefore, it may be prevented that the first image 121 and the second images 122, 123, 124 are erroneously confused with one another, and incorrect deviated amounts are set. Further, the user may visually recognize the deviated amounts. However, the first image 121 and the second images 122, 123, 124 may not necessarily be recorded in the mutually displaced positions along the front-rear direction 8, but the conveying step may be omitted. For another example, the first recording step may not necessarily be performed once but may be repeated, each time after the conveying step is performed, as well as the second recording step.

The embodiments described above are based on a condition that the carriage 23 urged by the ink tube 32 should be shifted upward evenly without tilting. However, the carriage 23 may not actually be shifted evenly upward but may be, for example, tilted to have a right-hand side thereof being higher and a left-hand side thereof being lower. Therefore, in the first recording step and the second recording step, while the recording head 39 is formed to have, on the bottom surface thereof, a plurality of nozzle arrays, which extend along the front-rear direction and align along the widthwise direction 9, it may be preferable that one of the nozzle arrays extending in a widthwise center is used to discharge the ink at the sheet 14. Thus, by using the nozzle array at the widthwise center in the recording head 39, which is less likely to be affected by the tilt of the carriage 23, in the first recording step and the second recording step, the deviated amounts may be accurately obtained.

Further, unevenness in the deviated amounts for the nozzle arrays due to the tilt of the carriage 23 may be corrected by use of the deviated amount for the nozzle array at the widthwise center position. In this regard, it may be necessary to recognize the tendency of the tilted carriage 23 along the widthwise direction 9 through, for example, experiments and simulations. For another example, a deviated amount for a left-side end nozzle array, which is on the left-side end within the nozzle arrays along the widthwise direction 9, and a deviated amount for a right-side end nozzle array, which is on the right-side end within the nozzle arrays, may be obtained, and the deviated amounts for all the other nozzle arrays may be calculated by use of the obtained deviated amounts for the nozzle arrays at the widthwise ends.

Moreover, the first and second images 121-124 recorded in the first recording step and the second recording step may not necessarily be the linear segments extending along the front-rear direction 8 but may be in a shape of, for example, square, circle, or dot, as long as the deviated amounts, which vary depending the lengths of the pausing periods, between the first image 121 and the second image 122-124 are recognizable by the shape. In this regard, it is preferable that the shape of the first and second images 121-124 is distinguishable with regard to the brightness so that the presence or absence of the first and second images 121-124 on the sheet 14 should be recognized based on the changes in the brightness in the reading step. For example, a shape having a linear segment, which intersects with the main scanning direction orthogonally, e.g., a rectangle, may be preferable.

Modified Example

Although examples of carrying out the invention have been described, those skilled in the art will appreciate that there are numerous variations and permutations of the inkjet printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Next, with reference to FIGS. 9 and 11, a modified example of the deviated amount setting operation will be described. In this regard, the steps similar to those in the deviated amount setting operation described in the second embodiment will be omitted, but difference from the second embodiment will be described in detail. That is, in the modified deviated amount setting operation, in the second recording step in S25, a third image 127 and a fourth image 128 are recorded in addition to the first image 121 and the second images 122-124. On the other hand, the conveying step in S24 is not performed in between S23 and S25. Therefore, after the first recording step in S22 and after being halted for the one of the predetermined pausing periods in S23, the second recording step is performed without conveying for the linefeed amount. Instead, the conveying step is performed after the second recording step, and the flow returns to S22 to repeat S22-S25 until the first through fourth images 125-128 are recorded.

More specifically, in the first recording step in S22, the controller 130 records first images 125A, 12513, 125C on the sheet 14. The first recording step in S22 is performed to S22 in the second embodiment. Following the first recording step in S22, the controller 130 moves the carriage 23 in the forward orientation. FWD to return to the move-start position. The carriage 23 pauses thereat for a predetermined pausing period (S2.3). Thereafter, in the second recording step in S25, the controller 130 manipulates the carriage 23 having been experienced the predetermined pausing period to record second images 126A, 126B, 126C. Thereafter, the controller 130 conveys the sheet 14 for the predetermined linefeed amount. The flow returns to S22 to record the first images 125A, 12513, 125C on the sheet 14, and the controller 130 moves the carriage 23 in the forward orientation FWD to return to the move-start position. After the predetermined pausing period, the controller 130 manipulates the carriage 23 to record the third images 127A, 127B, 127C. Thereafter, the controller 130 conveys the sheet 14 for the predetermined linefeed amount. The flow returns to S22 again to record the first images 125A, 125B, 125C on the sheet 14, and the controller 130 moves the carriage 23 in the forward orientation FWD to return to the move-start position. After the predetermined pausing period, the controller 130 manipulates the carriage 23 to record the fourth images 128A, 128B, 128C on the sheet 14.

In this regard, the second images 126A, 126B, 126C are recorded in the ink discharged from the recording head 39 in the same discharging timings at the discharging positions E1, E3, E4 toward the targeted positions L1, respectively. Meanwhile, the third images 127A, 127B, 127C are recorded in the ink discharged from the recording head 39 at discharging positions (not shown), which are upstream positions along the reverse orientation RVS apart from the discharging positions E1, E3, E4 for a distance A. In other words, the deviated amount for the third image 127 with respect to the targeted positions L1, L3, L4 is A. The fourth images 128A, 128B, 128C are recorded in the ink discharged from the recording head 39 at discharging positions (not shown), which are upstream positions along the reverse orientation RVS apart from the discharging positions E1, E3, E4 for a distance 2A. In other words, the deviated amount for the fourth image 128 with respect to the targeted positions L1, L3, L4 is 2A.

Therefore, as shown in FIG. 11, the ink for the third image 127 lands on the upstream position deviated from the second image 126 for the distance A along the reverse orientation RVS. Meanwhile, the ink for the fourth image 128 lands on the upstream position deviated from the second image 126 for the distance 2A along the reverse orientation RVS. In other words, the ink for the fourth image 128 lands on the upstream position deviated from the third image 127 for the distance A along the reverse orientation RVS. In this regard, one of the second image 126, the third image 427, and the fourth image 128 overlaps the first image 125 along the front-rear direction 8.

In the example shown in FIG. 11, the second image 126, the third image 127, and the fourth image 128 are recorded in the positions evenly spaced apart from one another along the widthwise direction 9. However, the distances among the second image 126, the third image 127, the fourth image 128 may not necessarily be even as long as the third image 127 is recorded in the upstream position with respect to the second image 126 along the reverse orientation RVS and the fourth image 128 is recorded in the upstream position with respect to the third image 127 along the reverse orientation RVS. For another example, the relative position among the second image 126, the third image 127, and the fourth image 128 along the front-rear direction 8 may not necessarily be limited to the relative position shown in FIG. 11. For another example, the second image 126, the third image 127, and the fourth image 128 may not necessarily be drawn in the thicker lines, as shown in FIG. 11 but may be drawn in a same thickness. Further, for another example, the first image 12, the second image 126, the third image 127, and the fourth image 128 may not necessarily be recorded in a same color but may be recorded in different colors.

According to the steps described above, as shown in an upper part of FIG. 11, the second images 126A, 126B, 126C, which are recorded by the carriage 23 pausing for the predetermined pausing period of 10 milliseconds or shorter at the move-start position, overlap the first images 125A, 125B, 125C respectively on the sheet 14. Meanwhile, the third images 127A, 127B, 1.2.8C and the fourth images 128A, 128B, 128C are recorded in the upstream positions with respect to the first images 125A, 125B, 125C respectively along the reverse orientation RVS.

On the other hand, as shown in a lower part of FIG. 11, the second images 126A, 126B, which are recorded by the carriage 23 pausing for the predetermined pausing period of 1000 milliseconds at the move-start position, are recorded in downstream positions with respect to the first images 125A, 125B respectively along the reverse orientation RVS. Meanwhile, the second image 126C overlaps the first image 125C at the targeted position L4 on the sheet 14. The third image 127A is recorded in a downstream position with respect to the first image 125A along the reverse orientation RVS, and the third image 12713 overlaps the first image 125B at the targeted position L3 while the third image 127C is recorded in an upstream position with respect to the first image 125C along the reverse orientation RVS. Further, the fourth image 128A overlaps the first image 125A at the targeted position L1, while the fourth images 128B, 128C are recorded in upstream positions with respect to the first images 125B, 125C respectively along the reverse orientation RVS.

Thus, the second image 126, the third image 127, and the fourth image 128, which are recorded by the recording head 39 experiencing the pausing period longer than 10 milliseconds, overlaps the first image 125, which is recorded by the recording read 39 experiencing the pausing period of 10 milliseconds or shorter at the move-start position, differently along the widthwise direction 9. Therefore, the controller 130 identifies one of the second image 126, the third image 127, and the fourth image 128, which overlaps the first image 125 in the deviated amount setting step in S29 and, based on the identification, the controller 13C) obtains the deviated amount between the landing position and the targeted position.

More specifically, as shown in the lower part of FIG. 11, as to the deviated amount with respect to the targeted position L1, the fourth image 128A overlaps the first image 125A, and the deviated amount 2A is obtained. Meanwhile, as to the deviated amount at the targeted position L3, where the third image 127B overlaps the first image 125B, the deviated amount A is obtained. Further, as to the deviated amount at the targeted position L4, where the second image 126C overlaps the first image 125C, a deviated amount zero (0) is obtained. Although FIG. 11 merely illustrates the patterns of the first-fourth images 125-128, which are recorded after the carriage 23 experiences the pausing periods of 10 milliseconds and 1000 milliseconds, deviated amounts in other patterns corresponding to the other lengths of pausing periods may be similarly obtained. For example, deviated amounts in other patterns of the first-fourth images 125-128 recorded when the carriage 23 experiences the pausing periods of 50 milliseconds and 100 milliseconds may be similarly obtained. For another example, in FIG. 11, the pattern of the first-fourth images 125-128 recorded after the carriage 23 experiences pausing period of 10 milliseconds is shown for the ease of explanation; however, recording of this pattern when the carriage 23 experiences the pausing period of 10 milliseconds may be omitted when the deviated amount setting operation is actually conducted.

The deviated amounts obtained in the deviated amount setting operation in the modified example may be stored in the EEPROM 134. In this regard, a method to identify the image overlapping the first image 125 in the deviated amount setting operation may not necessarily be limited. For example, the controller 130 may divide the image data generated from the read image into a plurality of areas, each of which contains the targeted position, a part of the first image 125, and one of the second-fourth images 126-128, and extend along the moving direction of the carriage 23 (e.g., areas defined by chain lines in FIG. 11). Further, the controller 130 may calculate the brightness of the image(s) contained in each area and identify an area, in which the calculated brightness values is the smallest. Thus, by identifying the area having the smallest brightness value, the one of the second-fourth images 126-128 overlapping the first image 125 may be identified. As to the example shown in FIG. 11, it may be identified that the fourth image 128A overlaps the first image 125A.

What is claimed is:

1. An inkjet printer comprising:

a body;

a carriage configured to move in an orientation from one end part toward the other end part;

a recording head mounted on the carriage and configured to discharge ink toward a targeted position on a sheet;

a connecting member connected to the body and the carriage, the connecting member being configured to be bendable in variable curvature along with the carriage being moved, the curvature being greater when the carriage is at the one end part than when the carriage is at the other end part; and a controller configured to execute steps comprising:

a moving step, in which the carriage is moved in the orientation after a period where the carriage is halted at the one end part for a length;

a measuring step, in which the period prior to the moving step is measured; and a discharging step, in which the recording head is manipulated to discharge the ink at the targeted position in the moving step, wherein, if the measured period is within a first length, in the discharging step, the recording head is manipulated to discharge the ink toward the targeted position at a first discharging timing; and wherein, if the measured period is within a second length which is longer than the first length, in the discharging step, the recording head is manipulated to discharge the ink toward the targeted position at a second discharging timing, the second discharging timing being advanced to be earlier than the first discharging timing.

2. The inkjet printer according to claim 1, further comprising:

a memory device configured to store deviated amounts along the orientation between the targeted position and landing positions of the ink discharged toward the targeted position from the recording head, which is mounted on the carriage being moved after the carriage is halted for the first length and the second length respectively;

wherein, when the measured period is within the second length, the controller is configured to execute a calculating step, in which a deviated length is calculated based on a moving velocity of the carriage and one of the deviated amounts stored in the memory device, and in which the second discharging timing is obtained by advancing the first discharging timing for the calculated deviated length; and wherein, in the discharging step, when the measured period is within the second length, the controller manipulates the recording head to discharge the ink toward the targeted position at the calculated second discharging timing.

3. The inkjet printer according to claim 2, wherein, when the measured period is within the second length, in the discharging step, the controller manipulates the recording head to discharge the ink toward a first targeted position at the second discharging timing and toward a second targeted position, which is in a downstream position with respect to the first targeted position in the orientation, at a third discharging timing, the third discharging timing being one of at a same timing and earlier timing than the first discharging timing and being later than the second discharging timing.

4. The inkjet printer according to claim 3, wherein the deviated amounts stored in the memory device comprise:

a first deviated amount being the deviated amounts on the sheet along the orientation between the targeted position and the landing positions of the ink discharged toward the targeted position from the recording head, which is mounted on the carriage being moved after the carriage is halted for the first length and the second length respectively; and a second deviated amount on the sheet along the orientation between the second targeted position and landing positions of the ink discharged toward the second targeted position front the recording head, which is mounted on the carriage being moved after the carriage is halted for the first length and the second length respectively, wherein, when the measured period is within the second length, in the calculating step, the controller calculates a first deviated length corresponding to the first deviated amount and a second deviated length corresponding to the second deviated amount based on the moving velocity of the carriage and the first and second deviated amounts stored in the memory device, and obtains the second discharging timing by advancing the first discharging timing for the calculated first deviated length and a third discharging timing by advancing the first discharging timing for the calculated second deviated length; and wherein, when the measured period is within the second length, in the discharging step, the controller manipulates the recording head to discharge the ink toward the first targeted position at the calculated second discharging timing and toward the second targeted position at the calculated third discharging timing.

5. The inkjet printer according to claim 4, wherein, when the measured period is within the second length, in the calculating step, the controller calculates an interpolated discharging timing, at which ink targeted at a third targeted position is discharged, based on the second discharging timing corresponding to the first targeted position and the third discharging timing corresponding to the second targeted position, the third targeted position being in between the first targeted position and the second targeted position along the orientation; and wherein, in the discharging step, the controller manipulates the recording head to discharge the ink toward the third targeted position at the interpolated discharging timing.

6. The inkjet printer according to claim 3, wherein, when the measured period is within the second length, the controller manipulates the recording head to discharge the ink toward a downstream targeted position, which is in a downstream position with respect to the second targeted position in the orientation, at the first discharging timing.

7. The inkjet printer according to claim 2, wherein, when the measured period is within a third length being longer than the first length and shorter than the second length, in the calculating step, the controller calculates an interpolated discharging timing corresponding to the third length based on the first discharging timing corresponding to the first length and the second discharging timing corresponding to the second length; and wherein, in the discharging step, the controller manipulates the recording head to discharge the ink toward the targeted position at the interpolated discharging timing.

8. The inkjet printer according to claim 1, wherein, when the measured period for the carriage is longer than the second length, in the discharging step, the controller manipulates the recording head to discharge the ink toward the targeted position at the second discharging timing.

9. The inkjet printer according to claim 1, further comprising;

an ink receiver at a position to face the recording head when the carriage is at the one end part, the ink receiver being configured to receive the ink from the recording head, wherein the controller is configured to execute a flushing step, in which the recording head is manipulated to discharge a predetermined amount of the ink toward the ink receiver, wherein the second length is a length required for the flushing step.

10. The inkjet printer according to claim 1, wherein the controller is configured to execute a waiting step, in which the moving step is suspended for a predetermined period when an amount of the ink discharged on the sheet in the discharging step exceeds a predetermined threshold amount; and wherein the second length is a length, for which the moving step is suspended.

11. The inkjet printer according to claim 1, wherein the connecting member comprises an elongated shape, the connecting member comprising a first part, which is on one end part of the connecting member and at which the connecting member is connected to the carriage, a second part, at which the connecting member is fixed to the body of the inkjet printer, and a third part, which is deformable in between the first part and the second part when the carriage moves along the scanning direction, curvature of the third part being greater when the carriage is at the one end part than curvature of the third part when the carriage at the other end part.

12. The inkjet printer according to claim 11, further comprising:

a cartridge mount configured to have an ink cartridge mounted thereon, the cartridge mount being arranged in the body of the inkjet printer at the other end part and at a downstream side with respect to the carriage along a sheet moving direction being orthogonal to the orientation, wherein the connecting member is an ink tube configured to supply the ink from the ink cartridge mounted on the cartridge mount to the recording head, the ink tube comprising the first part, the second part, the third part, and a fourth part being on a different end from the first part, the first part being connected to the recording head inside the carriage, a part of the ink tube closer to the second part with respect to the third part being extended outward from the ink carriage, the fourth part being connected to the cartridge mount;

wherein, when the ink carriage is at the one end part, the ink tube is bended to place the first part, the second part, and the third part to be arranged in an order of the third part, the first part, and the second part along the orientation; and wherein, when the ink carriage is at the other end part, the ink tube is bended to place the first part, the second part, and the third part to be arranged in an order of the second part, the third part, and the first part along the orientation.

13. A method to be executed by an inkjet printer, comprising:

a moving step, in which a carriage is moved from one end part toward the other end part after a period where the carriage is halted at the one end part for a length;

a measuring step, in which the period prior to the moving step is measured; and a discharging step, in which a recording head mounted on the carriage is manipulated to discharge the ink at a targeted position on the sheet in the moving step, wherein, if the measured period is within, a first length, in the discharging step, the recording head is manipulated to discharge the ink toward the targeted position at a first discharging timing; and wherein, if the measured period is within a second length which is longer than the first length, in the discharging step, the recording head is manipulated to discharge the ink toward the targeted position at a second discharging timing, the second discharging timing being advanced to be earlier than the first discharging timing.

* * * * *